US007065938B2

(12) United States Patent
Deckert

(10) Patent No.: US 7,065,938 B2
(45) Date of Patent: Jun. 27, 2006

(54) BEVERAGE BOTTLING PLANT FOR FILLING BOTTLES WITH A LIQUID BEVERAGE FILLING MATERIAL, AND A CONTAINER FILLING PLANT CONTAINER INFORMATION ADDING STATION, SUCH AS, A LABELING STATION HAVING A GRIPPER ARRANGEMENT, CONFIGURED TO ADD INFORMATION TO CONTAINERS, SUCH AS, BOTTLES AND CANS

(75) Inventor: Lutz Deckert, Gelsenkirchen (DE)

(73) Assignee: KHS Maschinen- und Anlagenbau AB, Dortmund (DE)

( * ) Notice: Subject to any disclaimer, the term of this patent is extended or adjusted under 35 U.S.C. 154(b) by 0 days.

(21) Appl. No.: 10/814,624

(22) Filed: Mar. 31, 2004

(65) Prior Publication Data

US 2004/0261363 A1 Dec. 30, 2004

(30) Foreign Application Priority Data

Apr. 1, 2003 (DE) ..... 103 14 635

(51) Int. Cl.
*B65B 53/02* (2006.01)
*B65B 11/00* (2006.01)

(52) U.S. Cl. ..... 53/441; 53/585; 53/589; 53/176

(58) Field of Classification Search ..... 53/415, 53/441, 131.1, 137.1, 137.2, 176, 551, 552, 53/585, 291, 292, 298, 557, 589
See application file for complete search history.

(56) References Cited

U.S. PATENT DOCUMENTS

| | | | | | |
|---|---|---|---|---|---|
| 3,888,067 | A * | 6/1975 | Cross et al. | 53/292 |
| 3,959,065 | A * | 5/1976 | Ashcroft | 156/423 |
| 4,016,704 | A * | 4/1977 | Fujio | 53/399 |
| 4,102,728 | A * | 7/1978 | Smith | 156/362 |
| 4,108,705 | A * | 8/1978 | Hadl et al. | 156/355 |
| 4,127,978 | A * | 12/1978 | Lucke | 53/585 |
| 4,144,631 | A * | 3/1979 | Fujio | 29/446 |
| 4,184,309 | A * | 1/1980 | Amberg | 53/399 |
| 4,412,876 | A * | 11/1983 | Lerner et al. | 156/64 |
| 4,446,616 | A * | 5/1984 | Waterman | 29/775 |
| 4,514,966 | A * | 5/1985 | Konstantin | 53/585 |
| 4,744,206 | A * | 5/1988 | Winter | 53/585 |
| 4,765,121 | A * | 8/1988 | Konstantin et al. | 53/442 |
| 4,910,941 | A * | 3/1990 | Nagano et al. | 53/291 |
| 5,566,527 | A * | 10/1996 | Drewitz | 53/295 |
| 5,715,651 | A * | 2/1998 | Thebault | 53/399 |
| 5,737,900 | A * | 4/1998 | Konstantin et al. | 53/295 |
| 5,916,343 | A * | 6/1999 | Huang et al. | 82/59 |
| 6,684,599 | B1 * | 2/2004 | Fresnel | 53/64 |

* cited by examiner

*Primary Examiner*—Stephen F. Gerrity
*Assistant Examiner*—Paul Durand
(74) *Attorney, Agent, or Firm*—Nils H. Ljungman & Associates

(57) ABSTRACT

A beverage bottling plant for filling bottles with a liquid beverage filling material, and a container filling plant container information adding station, such as, a labeling station having a griper arrangement, configured to add information to containers, such as, bottles and cans. The gripper arrangement is adjustable to handle sleeve labels of various diameters to permit the labeling of containers of various diameters by one gripper arrangement.

13 Claims, 11 Drawing Sheets

BEVERAGE BOTTLING PLANT FOR FILLING BOTTLES WITH A LIQUID BEVERAGE FILLING MATERIAL, AND A CONTAINER FILLING PLANT CONTAINER INFORMATION ADDING STATION, SUCH AS, A LABELING STATION HAVING A GRIPPER ARRANGEMENT, CONFIGURED TO ADD INFORMATION TO CONTAINERS, SUCH AS, BOTTLES AND CANS

BACKGROUND

1. Technical Field

The application relates to a beverage bottling plant for filling bottles with a liquid beverage filling material, and a container filling plant container information adding station, such as, a labeling station having a gripper arrangement, configured to add information to containers, such as, bottles and cans.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus being configured to introduce a predetermined volume of liquid beverage filling material into the interior of bottles to a substantially predetermined level of liquid beverage filling material, and the apparatus configured to introduce a predetermined flow of liquid beverage filling material comprising apparatus being configured to terminate the filling of beverage bottles upon liquid beverage filling material reaching said substantially predetermined level in bottles. There may also be provided a conveyer arrangement being configured and disposed to move bottles, for example, from an inspecting machine to the filling machine. Upon filling, a closing station closes filled bottles. There may further be provided a conveyer arrangement configured to transfer filled bottles from the filling machine to the closing station. Next, filled bottles are usually labeled in a labeling station after closing.

Thus, in the packaging of wares of diverse sorts, such as, for example, beverages or items of food, it has been found highly advantageous to configure the containers in which such wares are offered as advantageously and appealingly as possible. Aside from configuration of the body of containers, the container labeling, that is ever increasing in display, also plays an increasingly important role.

Accordingly, due to being highly conducive to increase sales, the advantageous outer configuration of containers and receptacles of all types is increasingly receiving attention.

One opportunity to configure containers and receptacles, such as, for example, bottles, in a particularly appealing manner, comprises labeling the containers with so-called sleeve labels.

Two distinct methods are available in sleeve labeling. In a first method, sleeve labels are used that have an inner diameter that is larger by a predetermined amount than the outer diameter of the containers that are to be labeled; this means that the sleeve labels must be shrunk upon being placed onto a container using an input of energy.

In a second method, sleeve labels are used that have an inner diameter that is smaller by a predetermined amount than the containers that are to be labeled. In this method, the sleeve labels are pulled with an elevated energy effort about the container whereupon they adhere due to the prior expansion leading to a corresponding contraction and due to the attendant frictional forces. Shrinking of the sleeve labels is not required in this method.

These sleeve labels are generally configured as a portion of an endless plastic tube from which they are cut with the respectively required length.

Upon severing, an individual sleeve label is received by a gripper and is positioned about the container that is to be labeled.

In the event that the plastic tube is in a correct position, there arises, as a function of the method that is being used, a pre-shrinking, or, however, the gripper releases its engagement with the sleeve label and moves into a non-engaging position.

The functioning that is free of errors and precise of the above-mentioned gripper is of particular importance for the disruption-free execution of the entire labeling process. It is to be noted that the operating size or expansion of the gripper and the position of the gripper expansion are to be moved with and within very small tolerances because the plastic tubes that are used, that have a wall thickness of only 0.05 millimeters, need to be maintained during the labeling process in a clamped or gripped manner that is neither too tightly nor too loosely.

In the event that the sleeve label is gripped too loosely, a premature release of the label from the gripper may result and this may lead to an imprecise positioning of the label. An overly tight gripping may lead to damage of the label or, respectively, of the image that is carried by the label. Both situations are undesirable in practical use and, accordingly, need to be prevented.

Such grippers are so-called format-parts, or formatted parts, meaning that they need to be exchanged upon each change of a container type that is to be labeled or, respectively, upon a change of the diameter of the container that is to be labeled.

Due to the unavoidable deviations in tolerances, hitherto it has been very laborious and expensive to correctly adjust the grippers either prior to utilization or during utilization. This is particularly of detriment due to the fact that known grippers do not entail the option to adjust the position of the expansion or operating size of the gripper without a change of other parameters, such as, for example, the magnitude of the operating size or spread or expansion of the gripper.

The expenses that are caused by such disadvantages are made most obvious when considering the fact that at one customary sleeve labeling station up to 30 positions, each having a gripper, are present and in standard sleeve labeling stations between 3 to 5 sets of format-parts are utilized.

OBJECT

One object of an embodiment of the application is believed at the time of the filing of this patent application to possibly reside broadly in a gripper arrangement in which adjustment work can be minimized.

SUMMARY

One feature of an embodiment of the application is believed at the time of the filing of this patent application to possibly reside broadly in a beverage bottling plant for filling bottles with a liquid beverage filling material, said beverage bottling plant comprising: a filling machine being configured to fill empty bottles with liquid beverage filling material; a conveyer arrangement being configured and disposed to move empty bottles to said filling machine; said beverage filling machine comprising a plurality of beverage filling positions, each beverage filling position comprising a beverage filling device for filling bottles with liquid beverage filling material; said filling devices comprising apparatus being configured to introduce a predetermined volume of liquid beverage filling material into the interior of bottles to a substantially predetermined level of liquid beverage filling material; said apparatus being configured to introduce a predetermined volume of liquid beverage filling material comprising apparatus being configured to terminate the filling of beverage bottles upon liquid beverage filling material reaching said substantially predetermined level in bottles; a closing station being configured and disposed to close filled bottles; a conveyer arrangement being configured and disposed to transfer filled bottles from said filling machine to said closing station; a labeling station being configured and disposed to receive bottles to be labeled; a conveyer arrangement being configured and disposed to convey bottles to said labeling station; said labeling station comprising: a storage being configured and disposed to store a continuous collapsed tube of flat uncut sleeve labels disposed sequentially one after the other; a mandrel structure; said mandrel structure being configured to open a continuous collapsed tube of uncut sleeve labels; said mandrel structure having a receiving end and a discharge end remote from said receiving end; a first set of roller apparatus being configured and disposed to advance an opened continuous tube of uncut sleeve labels along said mandrel structure from said receiving end towards said discharge end; said first set of roller apparatus being disposed adjacent said receiving end of said mandrel structure; a second set of roller apparatus being configured and disposed to advance an opened continuous tube of uncut sleeve labels along said mandrel structure to said discharge end; said second set of roller apparatus being disposed between said first set of roller apparatus and said discharge end of said mandrel structure; apparatus being configured and disposed to cut an open sleeve label from an opened continuous tube of uncut open sleeve labels to thus produce a cut open sleeve label for a bottle disposed at said discharge end of said mandrel structure; said cutting apparatus comprising a rotating disc having at least one sleeve cutting knife operatively connected thereto; each said at least one sleeve cutting knife being configured and disposed to be moved between a position of rest and a position of cutting; each said at least one sleeve cutting knife comprises a portion configured to move said at least one sleeve cutting knife into the cutting position, and also comprises a structure to move said at least one sleeve cutting knife into the rest position; said cutting apparatus also comprising at least one electromagnet configured and disposed to move said at least one sleeve cutting knife into the cutting position; said cutting apparatus being disposed between said first set of roller apparatus and said second set of roller apparatus; said mandrel structure comprising an expander apparatus being configured and disposed to sufficiently expand a portion of an uncut open sleeve label, immediately adjacent said cutting apparatus, between said first set of roller apparatus and said second set of roller apparatus, to make taut a portion of an opened tube of uncut open sleeve labels adjacent said cutting apparatus and thus to minimize bunching of an opened continuous tube of uncut open sleeve labels on said mandrel structure, and also to maximize precision of the cut being effectuated by said cutting apparatus; said second set of roller apparatus also being configured and disposed to remove a cut open sleeve label from said mandrel structure with sufficient velocity and to position a cut open sleeve label about a bottle disposed at said discharge end of said mandrel structure, and thus to permit a constant cut of a sleeve label being cut and elevated cutting speeds to afford shorter cycle times; and a gripper arrangement being configured and disposed to grip an open sleeve label cut by said cutting apparatus and to dispose a cut open sleeve label about a bottle to be labeled; said gripper arrangement comprising: a base structure; a first gripper jaw and a second gripper jaw; each gripper jaw having a first portion being configured to be disposed to hold a cut open sleeve in its open condition; each gripper jaw having a second portion being configured to be connectable to said base structure; each second gripper jaw portion having a slot-type passage; a first support structure being configured and disposed to connect said first gripper jaw to said base structure; a second support structure being configured and disposed to connect said second gripper jaw to said base structure; each support structure comprising a locating bolt; each locating bolt being configured and disposed to connect its corresponding support structure connected for rotation at said base structure to permit movement of said gripper jaws into a position wherein a cut open sleeve label is gripped by said gripper jaws and also into a position wherein a cut open sleeve label is released from the gripped condition; each support structure comprising a guide pin; said guide pin being configured connect a second gripper jaw portion to its corresponding support structure; an arrangement being configured and disposed to actuate said guide pins to move said gripper jaws into a position wherein a cut open sleeve label is gripped by said gripper jaws and also into a position wherein a cut open sleeve label is released from the gripped condition; each support structure comprising a passage having a diameter; each slot-type passage being configured to be disposed to be aligned with said passage of its corresponding support structure; each support structure comprising a stud; said stud being configured to be fixedly disposed in said support structure passage and to extend through said gripper jaw slot-type passage of said second gripper jaw portion; each second gripper jaw portion comprising an adjustment arrangement; each adjustment arrangement at least comprising: a stud screw being configured and disposed to be in contact with said fixed stud and to move said second gripper jaw portion and its corresponding gripper jaw between a first position and a second position, said second gripper jaw position being a position configured to minimize misalignment of a cut open sleeve gripped by said gripper jaws; and a spring configured and disposed to exert a bias on said stud screw and said second gripper jaw portion; each support structure further comprising a connector; said connector being configured and disposed to secure said second gripper jaw portion to its corresponding support structure upon movement of said second gripper jaw portion into said second gripper jaw position; and said bottling plant further comprising: apparatus being configured and disposed to affix a cut open sleeve label, positioned by said gripper arrangement about a bottle, to the surface of a bottle to be labeled.

Another feature of an embodiment of the application is believed at the time of the filing of this patent application to possibly reside broadly in a method of operating a container filling plant labeling station having a sleeve label gripper arrangement, configured to add a label to a container, said station comprising: an arrangement being configured and disposed to open a continuous collapsed tube of uncut sleeve labels; apparatus being configured and disposed to advance a tube of sleeve labels; apparatus being configured and disposed to cut a sleeve label; a gripper arrangement being configured and disposed to grip an open sleeve label and to position and to release an open sleeve label about a container to be labeled; said gripper arrangement comprising: a first gripper jaw and a second gripper jaw; a support arrangement for said gripper jaws; an arrangement being configured and disposed to position and to secure said gripper jaws in a position configured to minimize misalignment of a sleeve label on a labeled container; and said station comprising: apparatus being configured and disposed to affix an open sleeve label, positioned by said gripper arrangement about a bottle, to the surface of a bottle to be labeled; said method comprising the steps of: opening a continuous collapsed tube of uncut sleeve labels; advancing a continuous tube of labels; cutting a sleeve label; gripping an open sleeve label with said gripping jaws of said gripping arrangement; positioning a gripped sleeve label about a container to be labeled; releasing a gripped label from said gripper jaws; adjusting the position of said gripper jaws to minimize misalignment of a sleeve label on a labeled container; securing said adjusted position of said gripper jaws; and affixing a sleeve label, positioned by said gripper jaws about a container, to the surface of a container to be labeled.

Yet another feature of an embodiment of the application is believed at the time of the filing of this patent application to possibly reside broadly in a container filling plant container labeling station having a sleeve label gripper arrangement, configured to add a label to a container, said station comprising: an arrangement being configured and disposed to open a continuous collapsed tube of uncut sleeve labels; apparatus being configured and disposed to advance a tube of sleeve labels; apparatus being configured and disposed to cut a sleeve label; a gripper arrangement being configured and disposed to grip an open sleeve label and to position and to release an open sleeve label about a container to be labeled; said gripper arrangement comprising: a first gripper jaw and a second gripper jaw; a support arrangement for said gripper jaws; an arrangement being configured and disposed to position and to secure said gripper jaws in a position configured to minimize misalignment of a sleeve label on a labeled container; and said station comprising: apparatus being configured and disposed to affix a sleeve label, positioned by said gripper arrangement about a bottle, to the surface of a bottle to be labeled.

One feature or aspect of an embodiment is believed at the time of the filing of this patent application to possibly reside broadly in an arrangement that permits adjusting of the position of the gripper expansion without a change of other parameters.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The embodiments are explained in greater detail below with reference to the accompanying drawings.

DESCRIPTION OF EMBODIMENTS

Figure 1:
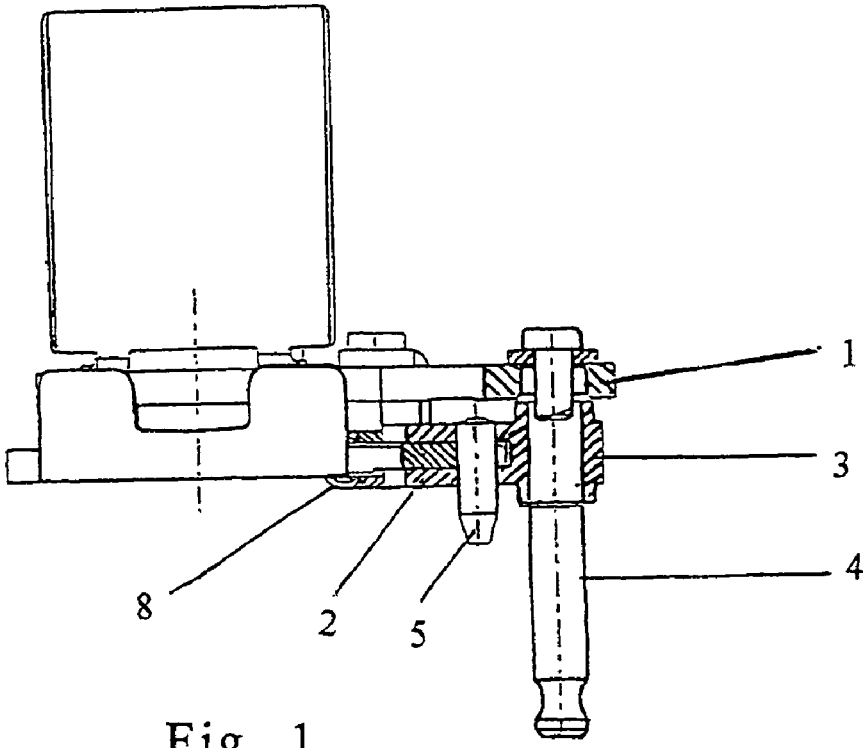
FIG. 1 illustrates in a simplified, cross-sectional side elevation a gripper in accordance with one embodiment of the application.

Further development details, advantages and possibilities of application of the application can be obtained from the following description of embodiments and the drawing. With this, all described and/or illustrated features per se or in any combination, comprise the substance of the application, regardless of their combination in the claims or their dependency. At the same time, the content of the claims is made a component of the description.

Figure 1A:
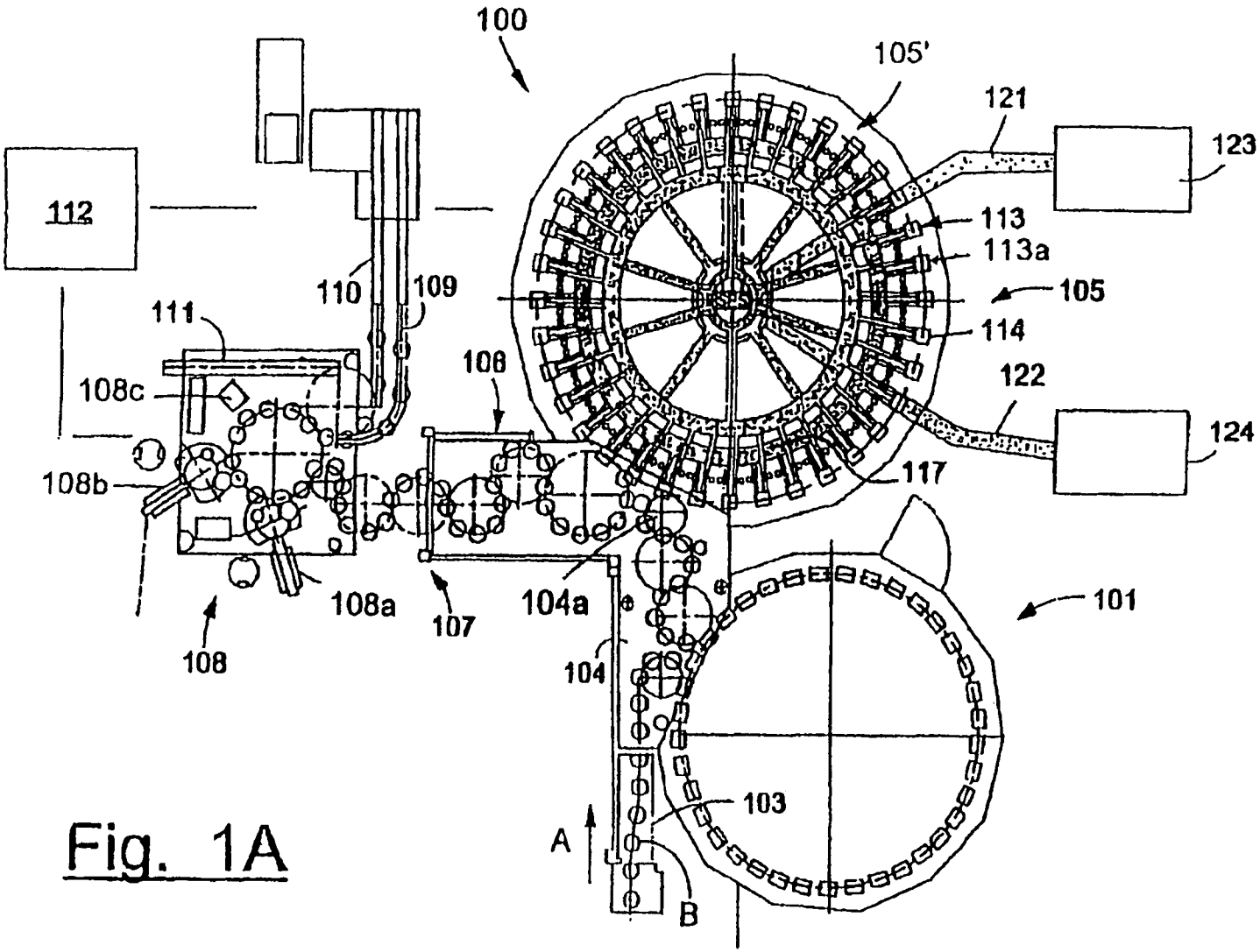
FIG. 1A is a schematic illustration of a container filling plant in accordance with one embodiment of the present application.

FIG. 1A shows schematically the main components of one embodiment example of a system for filling containers, specifically, an embodiment of a beverage bottling plant 100 for filling bottles B with liquid beverage filling material, in accordance with one embodiment, or in which system or plant could possibly be utilized at least one aspect, or several an aspects, of the embodiments disclosed herein.

FIG. 1A shows a rinser or rinser station 101, to which the containers, namely bottles B, are fed in the direction of travel as is indicated by the arrow A, by means of a conveyer line or conveyer arrangement 103, and downstream of rinser station 101, in the direction of travel as is indicated by the arrow A, the rinsed bottles B are transported to a beverage filling machine 105 by means of a conveyer line or conveyer arrangement 104 that is formed, for example, by a star wheel conveyer or a plurality of star wheels of a conveyer arrangement. The conveyer arrangement 104 may possibly have a star wheel 104*a* that introduces bottles B to the filling machine 105.

Downstream of the filling machine 105, in the direction of travel of the bottles B, there can preferably be a closer or closer station 1106 which closes the bottles B.

The closer or closer station 106 can, for example, be connected directly to a labeling device or labeling station 108, such as, for example, by means of a conveyer line or conveyer arrangement 107 that may be formed, for example, by a plurality of star wheels of a conveyer arrangement.

In the illustrated embodiment, the labeling device or labeling machine or labeling station 108 has, for example, three outputs, namely one output formed by a conveyer or conveyer arrangement 109 for bottles B that are filled with a first product. The first product may possibly be provided by a product mixer 123 that is connected to the filling machine 105, for example, through a conduit 121, and bottles B that are filled with a predetermined volume of liquid beverage filling material, that is, the first product, are then labeled by a labeling module 108*a* in the labeling stations 108 corresponding to this first product delivered from product mixer 123 to the beverage filling machine 105 and thence to the corresponding bottles B.

A second output that is formed by a conveyer or conveyer arrangement 110 is provided for those bottles B that are filled with a second product. The second product may emanate from a second product mixer 124 that is connected, for example, through a conduit 122 to the filling machine 105, and these bottles B filled with a predetermined volume of liquid beverage filling material comprising the second product are then correspondingly labeled by a labeling module 108*b* in the labeling station 108 corresponding to this second product.

A third output, for example, formed by a conveyer or conveyer arrangement 111, removes any bottles B which have been incorrectly labeled as may have been determined by an inspecting device or an inspecting station, or an inspecting module 108*c* that may possibly form a part of the labeling station 108.

In FIG. 1A item 112 is a central control unit or, expressed differently, a controller or a system which includes a process controller that, among other things, controls the operation of the above-referenced system or plant.

The beverage filling machine 105 is preferably of the revolving design, with a rotor 105', which revolves around a vertical machine axis. On the periphery of the rotor 105' there are a number of filling positions 113, each of which comprises bottle carriers or container carriers 113*a* that are configured and disposed to present bottles B for filling, as well as a filling device or element or apparatus 114 located or configured to be located above the corresponding container carrier 113*a* and the corresponding bottle B presented by the carrier 113*a*. The filling device or apparatus 114 comprises an apparatus configured to introduce a predetermined volume of liquid beverage filling material into the interior of bottles B to a predetermined level of liquid beverage filling material. Furthermore, the filling device or apparatus comprises an apparatus configured to terminate the filling of bottles upon liquid beverage filling material reaching the predetermined level in bottles B. In other words, filling elements 114 are configured and disposed to provide a predetermined flow of liquid beverage filling material from the source thereof, such as, product mixers 123 and 124, into the bottles B.

The toroidal vessel 117 is a component, for example, of the revolving rotor 105'. The toroidal vessel 117 can be connected by means of a rotary coupling or a coupling that permits rotation, and by means of an external connecting line 121 to the external reservoir or product mixer 123 to supply the product, that is, product mix 1, for example.

As well as the more typical filling machines having one toroidal vessel, it is possible that in at least one possible embodiment a filling machine could possibly be utilized wherein each filling device 114 is preferably connected by means of two connections to a toroidal vessel 117 which contains a first product, say by means of a first connection, for example, 121, and to a second toroidal vessel which contains a second product, say by means of the second connection, for example, 122. In this case, each filling device 114 can also preferably have, at the connections, two individually-controllable fluid or control valves, so that in each bottle B which is delivered at the inlet of the filling machine 105 to a filling position 113, the first product or the second product can be filled by means of an appropriate control of the filling product or fluid valves.

It will be understood that while a two-product assembly or system of a bottling plant is illustrated in FIG. 1A, the disclosure is equally applicable to single-product installations, or other commensurate embodiments.

Figure 1B:
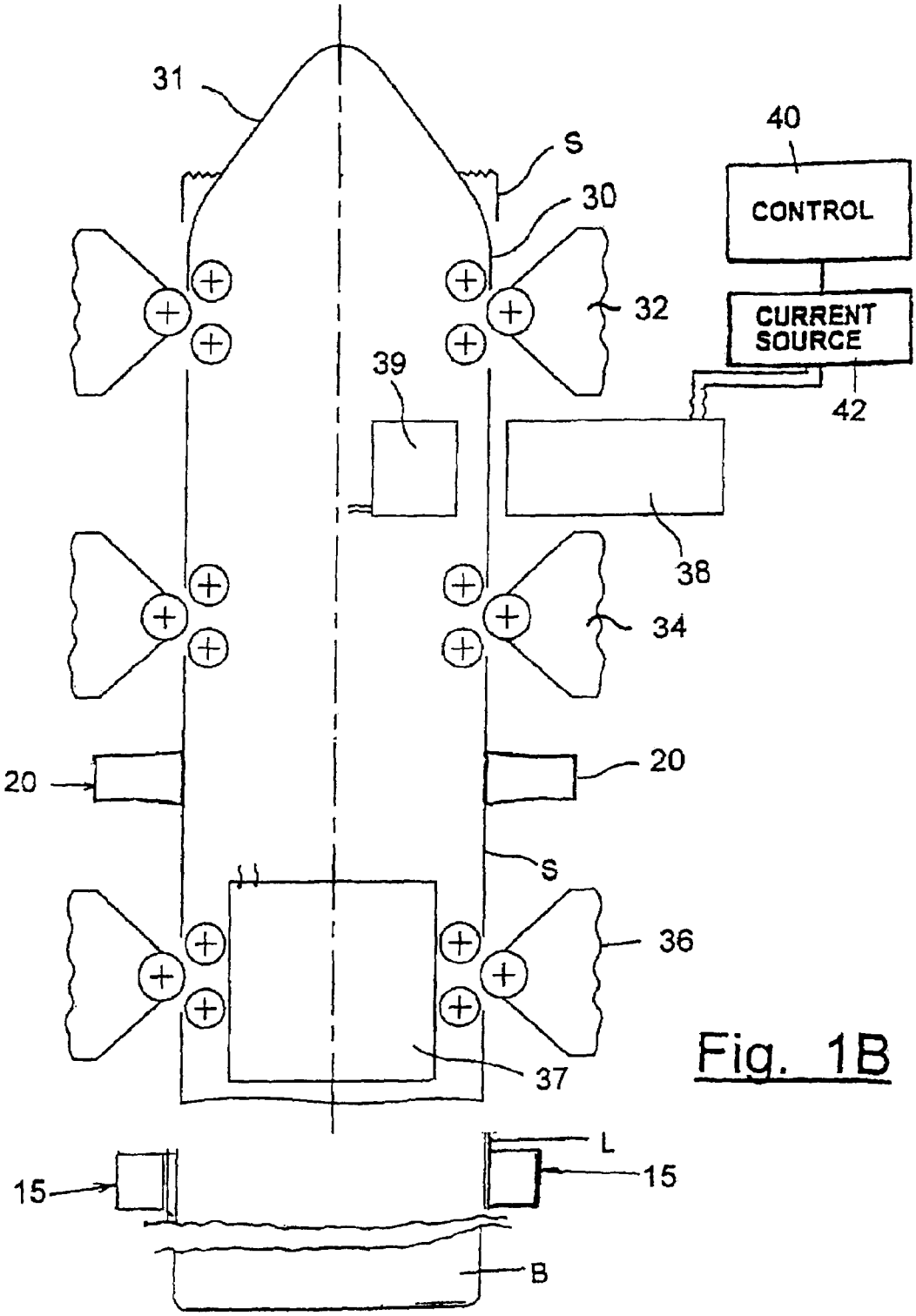
FIG. 1B illustrates the arrangement for advancing a sleeve label tube on a mandrel in accordance with one embodiment of the present application.
Figure 3:
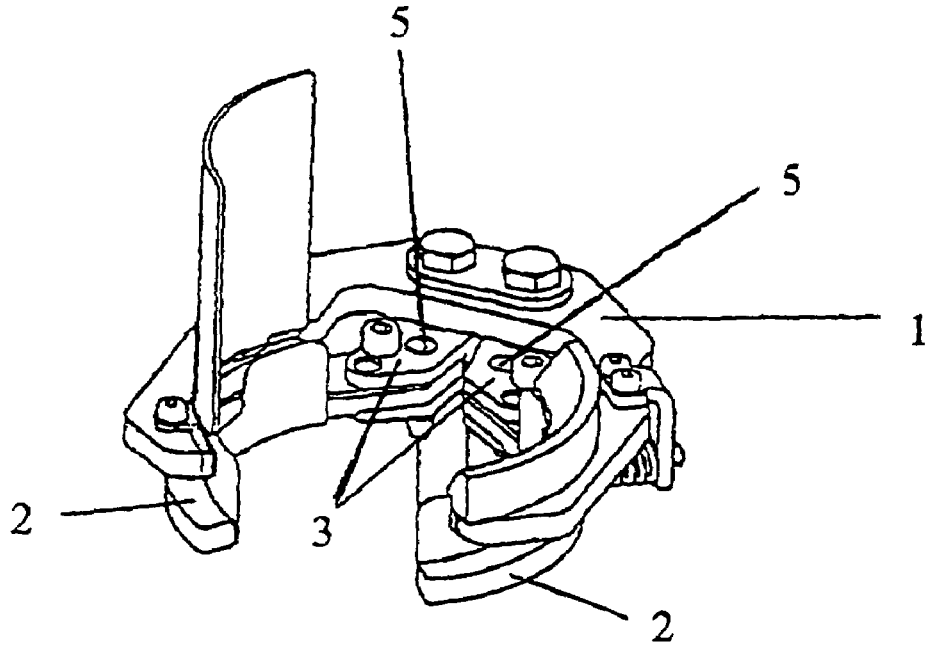
FIG. 3 is a 3-D or three-dimensional illustration of a full view of the gripper of FIG. 1.
Figure 4:
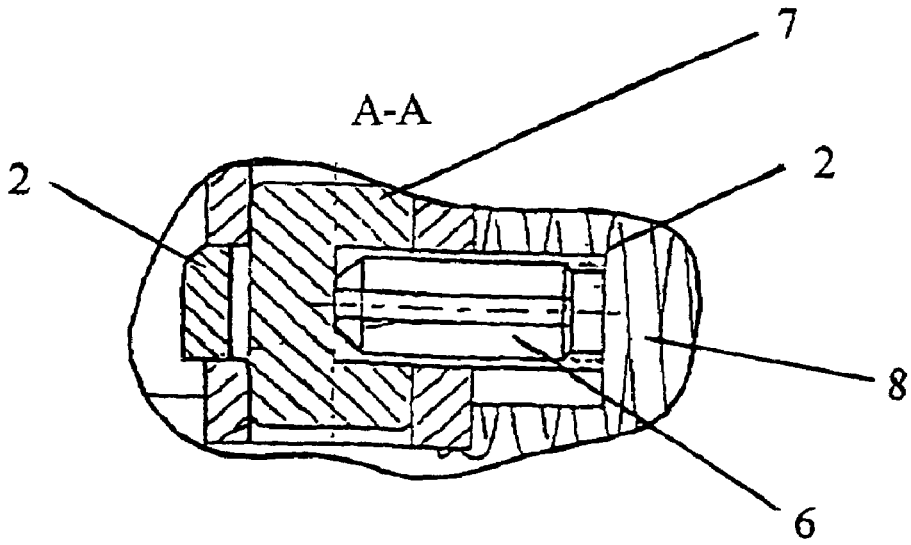
FIG. 4 is a detail of portion along line A—A in FIG. 2 shown in cross-section and drawn to a larger scale.

With reference to FIG. 1B there is illustrated a mandrel structure 30 that has a conical receiving end 31 for receiving a portion of a sleeve label tube S that is advanced by roller arrangements 32, 34, and 36, comprising, for example suitably mounted pinch rollers, along the body of the mandrel 30 towards a bottle B that is to receive a cut sleeve label L. The mandrel 30 is surrounded by a cutting arrangement 20 that is disposed between roller arrangements 34 and 36. The mandrel may be of an expanding type with pressure bodies, not shown in particular details, that may possibly be actuated through energy stored in an accumulator 37, or several accumulators, for electrical energy within the mandrel 30. With such an arrangement it is of particular advantage that the at least one accumulator 37 be disposed at the lower end of the mandrel 30. This permits that the accumulator 37 can be exchanged without dismantling of the mandrel 30 or, respectively, without removal of the label tube S from the mandrel 30 or, respectively, the removal of the mandrel 30 from the labeling station 108.

A further approach of the delivery of energy to the mandrel 30 resides therein that electrical energy is transferred into the mandrel 30 by way of induction. In this method, a transmitter 38 of induction energy is disposed at the labeling station or machine 108. The interior of the mandrel 30 houses a receiver 39 for induction energy and the receiver 39 captures the electromagnetic pulses that are emitted by the transmitter 38 of induction energy, and converts the sent electromagnetic impulses again into electrical energy.

Furthermore, FIG. 1B illustrates the location of a gripper arrangement 15 that is configured to grip a cut open sleeve label L and to dispose the label L about a bottle B, as well as to release a label L from its grip.

The arrangement shown in FIG. 1B Includes a source for the supply of current 42 and a control arrangement 40 for control of the sleeve label handling arrangement in accordance with FIG. 1B. It will be appreciated that in at least one embodiment of the application, the central control 112 is operatively connected to control 40 of the labeling station 108.

Figure 2:
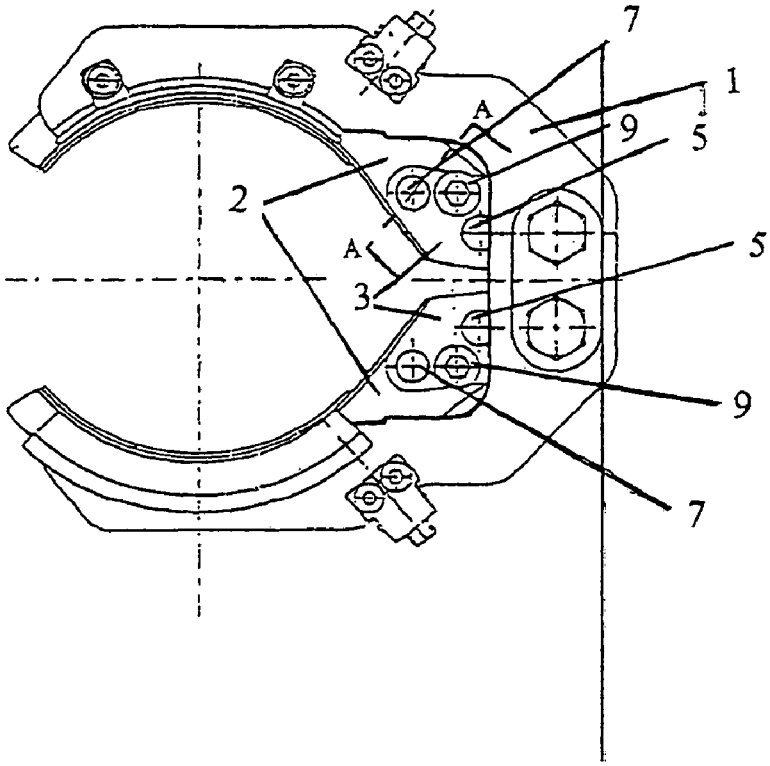
FIG. 2 is a top plan view of the gripper according to FIG. 1.

As is shown in FIGS. 1 and 2, the gripper has a U-shaped base body 1 at which all further elements are disposed, directly or indirectly, moveably or immovably. A further important component are two gripper jaws 2 that are disposed in mirror-image manner, and each is held by a support structure 3.

These support structures 3 are respectively disposed so as to be able to rotate or turn, and are respectively journalled at a locating bolt 4. These locating bolts 4, accordingly, are the centers of rotation for the operating movement or movement of the expanded position of the gripper, or movement of the expanded position of the gripper jaws.

Figure 5:
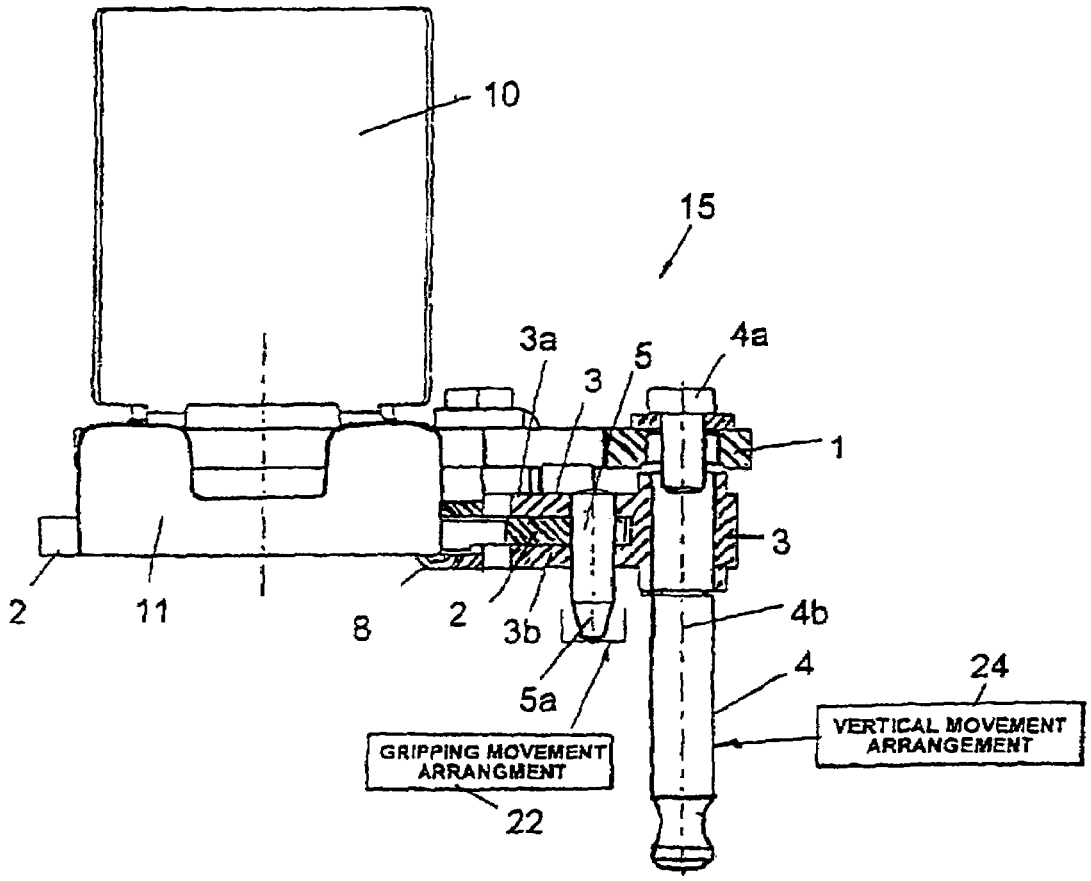
FIG. 5 is a view similar to FIG. 1 and identifying additional detail.

This operating movement is initiated by a force acting on the guide pins 5. The guide pins 5 are received in a retainer, not shown in greater detail but are schematically illustrated in FIG. 5; and this retainer is configured to carry out a swinging movement that is transferred, via the guide pins 5, to the gripper jaws 2 which swinging movement thus being the equivalent of the spread or expansion of the gripper.

In addition to the above-described "operating function" that is performed by the guide pins 5, these guide pins connect the gripper jaws 2 to the support structures 3 and also provide the point of rotation for the adjustment of the position of the spread or expansion of the gripper jaws.

The change of the position of the spread or expansion of the gripper jaws is respectively carried out by way of a stud screw or set screw 6 that is disposed within a corresponding gripper jaw 2, which set screw is supported on a stud 7, with the set screw 6, due to the design structure of the gripper being continually pressed against the stud 7 by the force of a coil spring 8.

The position of the gripper jaw 2 and of the support structure 3 with respect to one another is determined by the combination of the stud 7 and the set screw 6. Since the set screw 6 that is disposed in the gripper jaw 2, due to the force of the coil spring 8, is continuously in contact with the stud 7, and since the stud 7 is journalled without play in the support structure 3, and since, furthermore, the opening that is provided in the gripper jaw 2 for receiving the stud 7 is configured as a slot, the position of the gripper jaw 2, in reference to the support structure 3, can be varied by either screwing the set screw 6 in and by screwing the set screw 6 out in reference to stud 7.

FIG. 5 illustrates schematically the actuation of gripper jaw 2 that carries a guide portion or blade 11 that is configured to engage the cut open sleeve label L. The retained end of gripper jaw 2 is positioned between the upper portion 3*a* and the lower portion 3*b* of support structure 3. Guide pin 5 extends through upper portion 3*a*, through the retained end of gripper jaw 2, and through the lower portion 3*b* of support structure 3. In one possible embodiment of the application, guide pin 5 is moved by an arrangement 22 that is configured and disposed to swing the gripper jaw 2 about the axis 5*a* of guide pin 5, and thus permit the gripper jaw 2 to perform the expansion movement of gripper jaw 2. The arrangement to swing guide pin 5 may possibly be an arrangement that is functioning similarly to the arrangement for closing and opening of jaws as described in U.S. Pat. No. 4,184,309 issued to Amberg on Jan. 22, 1980.

It will be appreciated that in at least one possible embodiment of the application the gripper arrangement 15 can be moved by an arrangement 24 in reference to a bottle B that is disposed beneath mandrel structure 30 so as to position the cut open sleeve label L about a bottle B.

In at least one possible embodiment of the application, the bottle may be moved with reference to the gripper arrangement 15.

Figure 6:
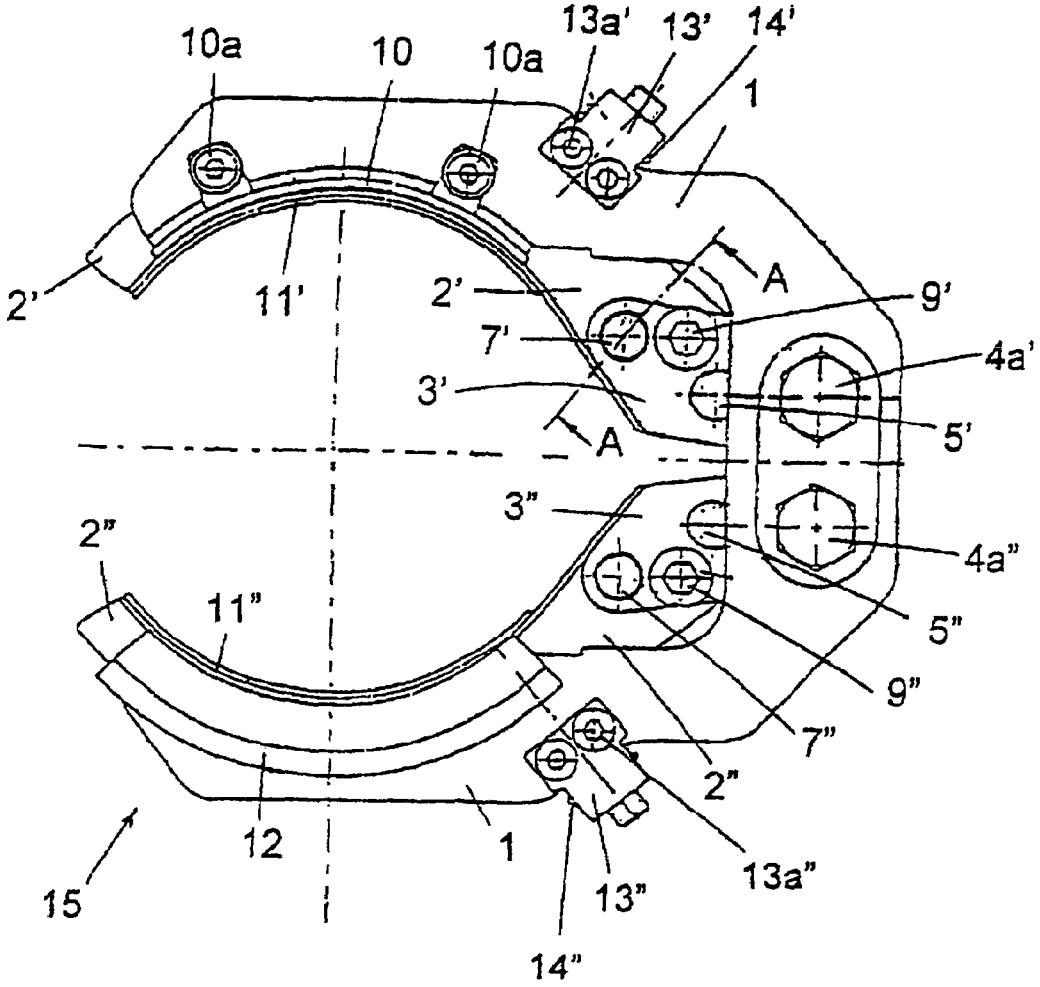
FIG. 6 is a view similar to FIG. 2 and identifying additional detail.

With reference to FIG. 6, the gripper arrangement 15 has a U-shaped base body or base structure 1 that is configured to embrace mandrel structure 30, compare FIG. 1B. Gripper arrangement 15 has a first gripper jaw 2' that is connected to base structure 1 by way of support structure 3'. Gripper jaw 2' carries a gripper blade 11' that possibly interacts with guide structure 10 that is secured to base structure 1 by means of suitable fasteners 10*a*.

The connection of gripper jaw 2' to base structure 1 is in accordance with the description of FIG. 2 above and comprises guide pin 5', an arrangement configured and disposed to precisely set the position of the expansion of gripper jaw 2', which arrangements comprises a stud 7' and details discussed herein above and herein below. There is also provided a clamping structure, such as, a threaded screw 9' that fixes the ultimate alignment and position by also connecting the gripper jaw 2' to support structure 3'

The lower portion of FIG. 6 shows the features of the attachment of second gripper jaw which gripper jaw is identified by reference numeral 2" and its associated components are identified correspondingly. However, gripper blade 11" is possibly configured to interact with guide body 12 that is connected to base structure 1. Reference numerals 4*a'* and 4*a"* designate fasteners that are possibly positioned in line with axis 4*b* of a corresponding locating bolt 4, compare FIG. 5.

Figure 7:
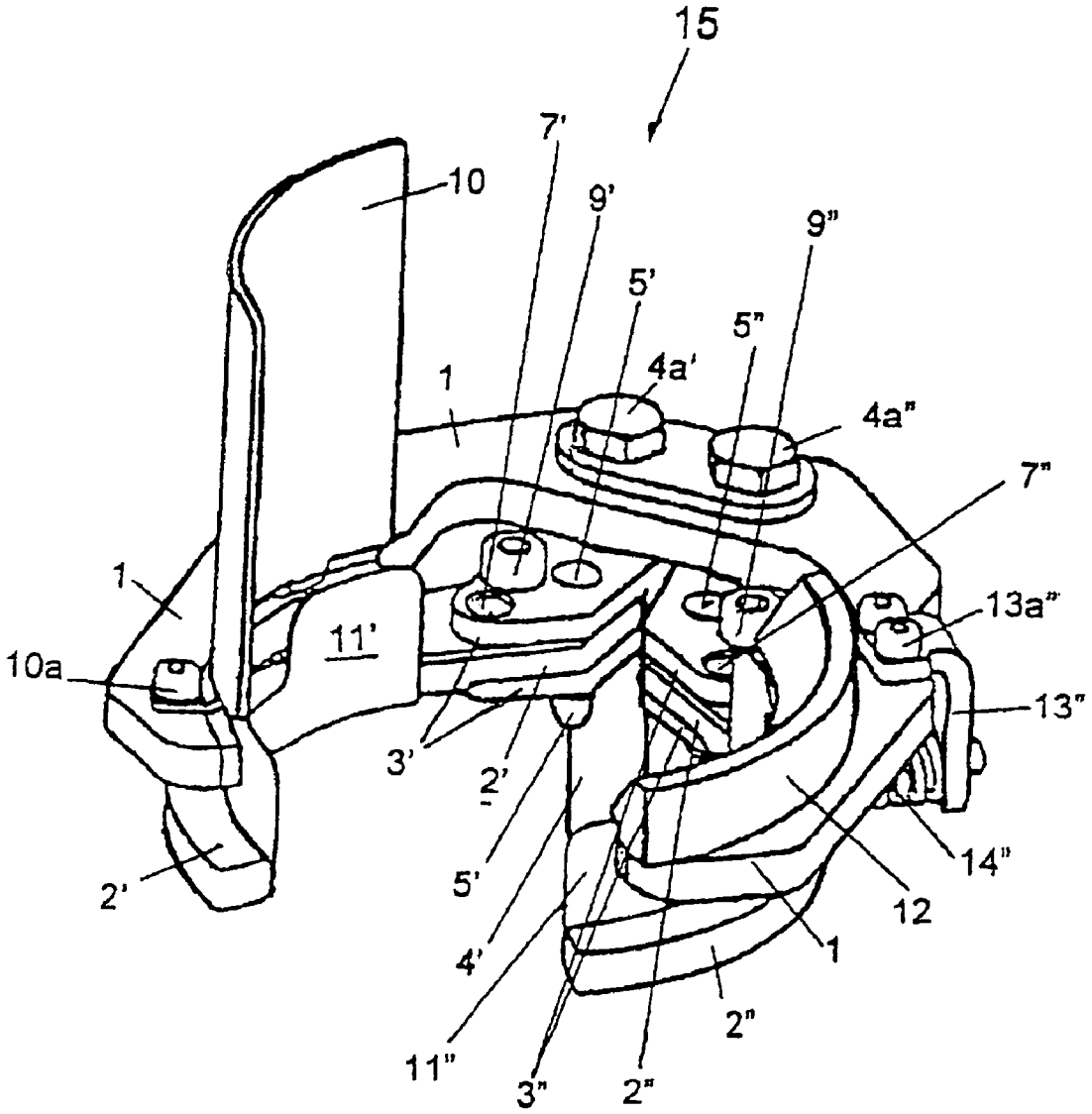
FIG. 7 is a view similar to FIG. 3 and identifying additional detail.

FIG. 7 is a perspective view of the gripper arrangement 15 and shows most clearly the external components described. In FIG. 7 it is clear that a spring 14" is mounted on a holder 13" that is connected to base structure 1 by suitable fasteners 13*a"*. This spring 14" may possibly serve as a backstop for gripper jaw 2" and a similar arrangement with a spring 14', a holder 13' and fasteners 13*a'* is provided for gripper jaw 2', compare FIG. 6.

As is clear from FIG. 7, the gripper jaw 2' has a free end which carries plate or blade 11 that possibly interacts with guide part 10 to retain the leading end of the open cut sleeve label L in gripped condition during the transport of the open cut sleeve label L onto the container B that is to be labeled.

The retained end of gripper jaw 2' is disposed in the U-shaped portion of the support structure 3'.

In order to adjust the relative position of the retained end of gripper jaw 2, the described combination of set screw 6, stud 7, and spring 8 may possibly function in one possible embodiment as is described next with reference to FIG. 8.

The support structure 3 comprises an upper portion 3*a* and a lower portion 3*b*, and also has a passage 3*c* that is sized to hold stud 7 in the position shown, that is, extending from the upper portion 3*a* of support structure 3, through a slot 2*a* that is formed in the retained end of gripper jaw 2, and into the lower portion 3*b* of the support structure 3. The stud 7 is fixed in position so as to provide a bearing for stud screw or set screw 6. Particularly, a groove 7*a* is provided in stud 7 which groove 7*a* is sized to receive the left end of set screw 6. Set screw 6 is threadingly engaged with its male screw threads 6*a* in the female screw threads 2*b* of the retained end of jaw 2, and pressure exerted on the retained end jaw 2 by the spring 8 will be transmitted to set screw 6 so as to urge set screw 6 into the groove 7*a* of stud 7.

Figure 8:
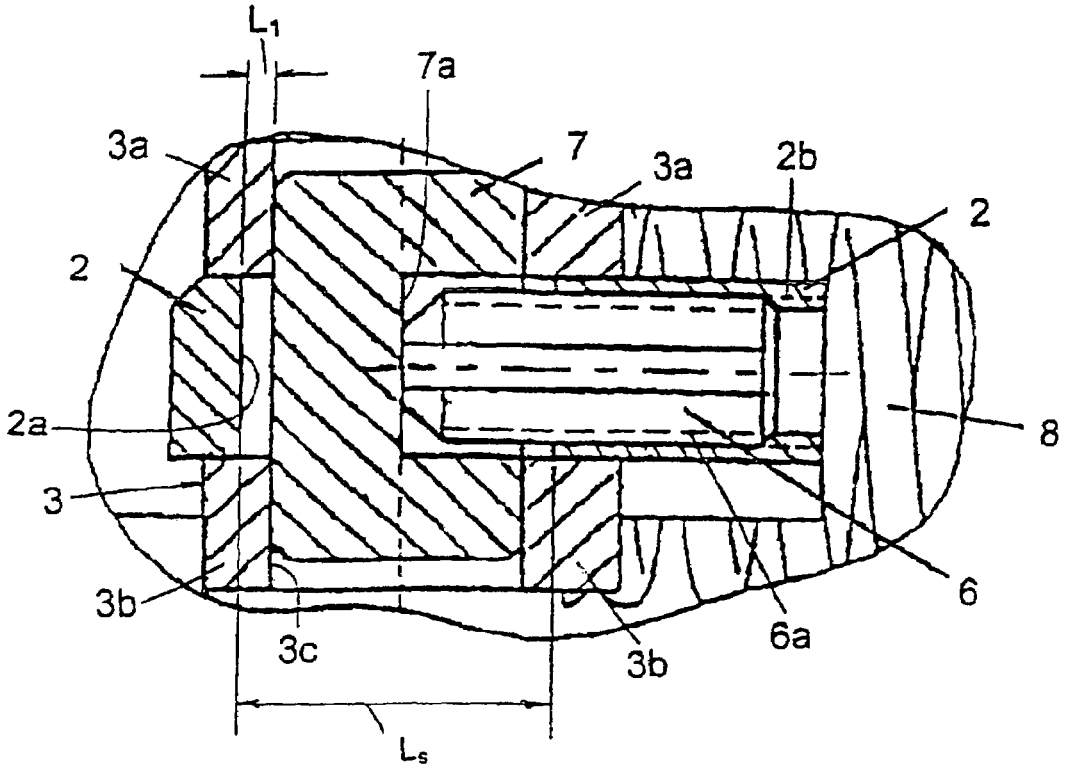
FIG. 8 is a view similar to FIG. 4 and identifying additional detail.

The retained end of jaw 2 has a slot 2*a* that has a length that is identified by the letter $L_s$ in FIG. 8.

Depending on the direction of the screw threading 2*a* of retained end of jaw 2 and the screw threading 6*a* of set screw 6, turning of the set screw 6 will cause the following. For example, turning of the set screw 6 in one direction will shift the retained end of jaw 2 to the right side in the shown illustration of 8 and consequently move the free end of jaw 2 in a corresponding manner. Turning the set screw 6 in the opposite direction will cause movement of the retained end of jaw 2 into the position that is indicated by length $L_1$ in FIG. 8.

As mentioned, the turning of set screw 6 will cause movement of the retained end of jaw 2 and attainment of the precise position of jaw 2, accordingly, is determined by the adjustment that is carried out with set screw 6.

The movement of the support structure 3 remains unchanged, only the position of the spread or expansion of the gripper jaw 2 is changed, whereby the guide pin 5 comprises the point of rotation or turning of the change of the position of the spread or expansion of the gripper jaw.

By a suitable clamping device 9, for example, a threaded screw, (elements 9' and 9" shown in FIG. 7), the achieved position can be fixed upon completion of the adjustment work.

Figure 9:
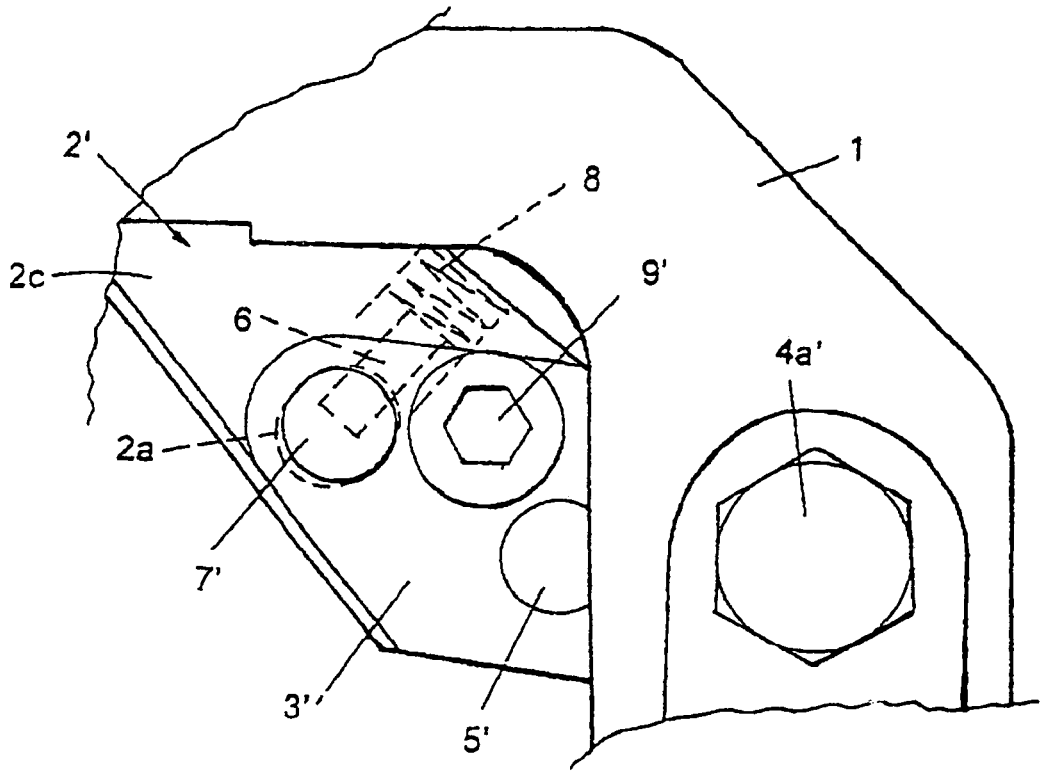
FIG. 9 is a top plan view of the connection of a retained end of a gripper jaw at a support structure in accordance with one embodiment of the application.

FIG. 9 shows the retained end 2*c* of gripper jaw 2' and the described elements in a top plan view. Thus, retained end 2*c* of gripper jaw 2' is mounted in support structure 3', and guide pin 7' is approximately centrally positioned in slot or slot-type passage 2*a*. This condition is fixed by threaded fastener 9'. Guide pin 5' functions as described above with reference to FIG. 5.

In further embodiments of the present application, solutions that differ from the above-described embodiments for varying the position of the expansion of the gripper jaws 2 can be provided.

Thus, it is possible, for example, to directly adjust gripper jaw 2 and support structure 3 with respect to one another by way of a combination comprising a pinion gear and a corresponding pinion rod, whereby the pinion gear is disposed, for example, concentrically with respect to the guide pin 5 and the pinion rod is disposed to permit rotation thereof but is fixed as to position on or within the gripper jaw 2.

Figure 10:
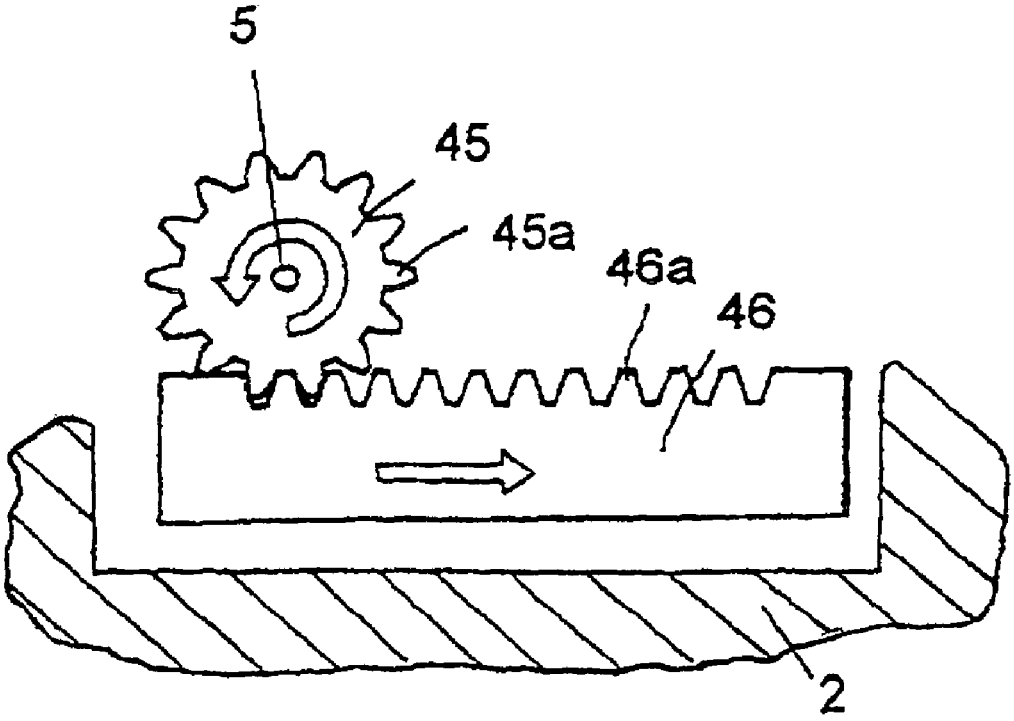
FIG. 10 is a schematic illustration of a pinion and pinion gear shaft for adjusting gripper jaw positions in accordance with one embodiment of the application.
Figure 11:
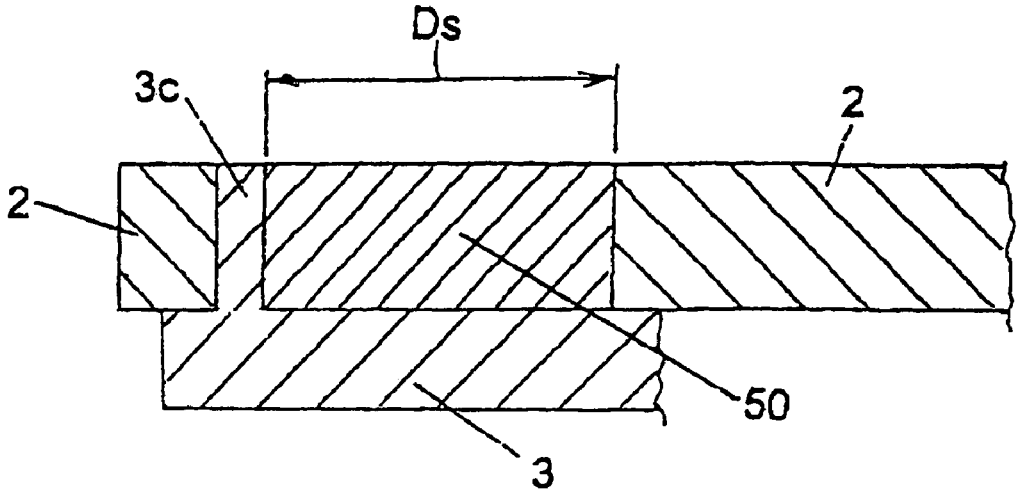
FIG. 11 is an illustration of utilization of a spacer element that is configured to position the gripper jaw in accordance with one embodiment of the application.

More specifically, it is possible, for example, to directly adjust gripper jaw 2 and support structure 3 with respect to one another by way of a combination comprising a pinion gear 45 having gear teeth 45*a*, illustrated schematically in FIG. 10 and a corresponding pinion rod 46 having gear teeth 46*a*, illustrated schematically in FIG. 10, whereby the pinion gear 45 is disposed, for example, concentrically with respect to the guide pin 5 and the pinion rod 46 is disposed to permit rotation thereof but is fixed as to position on or within the gripper jaw 2.

In a further embodiment it is suggested the realize the change of the position of the spread by utilization of an abutment and at least one spacer element, whereby such spacer elements may comprise planar elements, such as, for example, sheet metal of varying thicknesses, or also spacer rings of various diameters.

Thus, in at least one possible embodiment of the application, it is suggested to realize the change of the position of the spread or expansion of gripper jaws 2' and 2" by utilization of an abutment 3*c* of support structure 3 and at least one spacer element 50, with such spacer elements 50 possibly being planar elements having a thickness and/or length dimension $D_s$, such as, for example, sheet metal of varying thicknesses.

When using spacer rings, it is of particular advantage to provide a pin-shaped receiving structure for the spacer rings, whereby the outer diameter of the receiving structure and the inner diameter of the various spacer rings should be dimensioned so as to cooperate without significant play.

Figure 12:
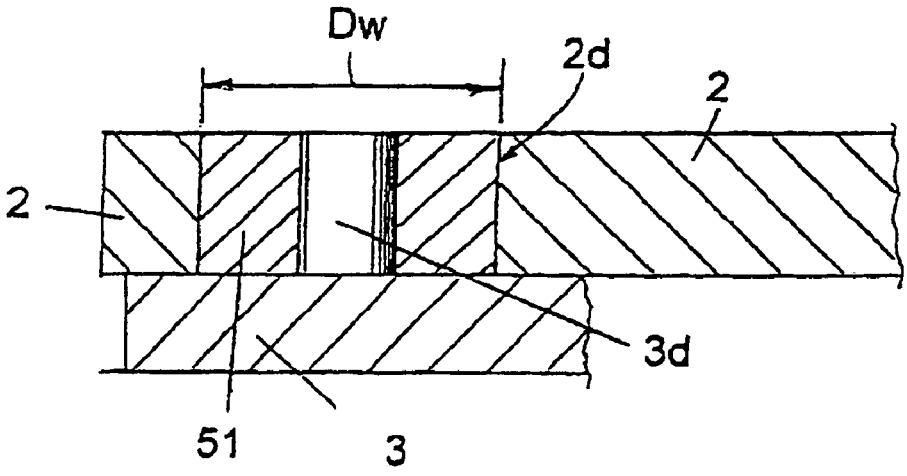
FIG. 12 is an illustration of utilization of a spacer ring that is configured to position the gripper jaw in accordance with one embodiment of the application.

With reference to FIG. 12, when using spacer rings, for example spacer ring 51, it is of particular advantage to provide a pin-shaped receiving structure, such as receiving structure 3*d*, for the spacer ring 51, whereby the outer diameter of the receiving structure and the inner diameter of the various spacer rings should be dimensioned so as to cooperate without significant play.

The adjustment of the position of the spread or expansion is done by positioning of spacer rings of different outer diameters onto the pin-shaped receiving stud that is disposed, for example, on the support structure 3. When the gripper jaw 2, is permanently pressed, for example, by way of the force of a spring, by means of the abutment that is disposed on the gripper jaw against the spacer ring, the position of the spread or expansion can be varied in this manner.

With reference to FIG. 12, the adjustment of the position of the spread or expansion is done by positioning the spacer ring 51 having the required outer diameter $D_w$ onto the pin-shaped receiving stud 3*d* that is disposed, for example, on the support structure 3. Once the gripper jaw 2, is permanently pressed, for example, by way of the force of a spring, by means of the abutment 2*d* that is disposed on the gripper jaw 2 against the spacer ring 51, the position of the spread or expansion of the gripper jaws 2' and 2" can be adjusted in this manner.

Realization of other embodiments not explicitly described herein to technically realize a change of the position of the spread is not to lead to leaving the path of the technical teaching of the present application.

It will be appreciated that the application in at least one aspect is concerned with the prevention or minimization of misalignment of or even damage to a sleeve label that is to be placed about a container to be labeled. Misalignment may possibly entail that the sleeve label is placed too high in position on a container, or it is placed too low in position about a container. Furthermore it is important that the sleeve label is free of bulges, folds, and wrinkles, either extending vertically or extending horizontally or in other directions, that is, the label has to be maintained and released by the gripper arrangement so as to provide a smooth appearance, i.e., an appearance without bulges or air-pockets, on a container to be labeled upon release from the gripper arrangement and positioning on a container to be labeled. Furthermore, the sleeve label possibly needs to be positioned with the necessary roundness about a container to be labeled, that is, a precise concentricity of the sleeve label with respect to the container to be labeled needs to be maintained prior to and during gripping and up to release of the gripped sleeve label, so as to ensure that the label is positioned with minimized misalignment about a container to be labeled.

Thus, one feature or aspect of an embodiment is believed at the time of the filing of this patent application to possibly reside broadly in a gripper device for handling foil-type tube sleeves for use in shrink-sleeve labeling stations or stretch-sleeve labeling stations of bottling plants, for example, with provision being made that means are present that can adjust the position of the gripper expansion of the gripper jaws, or the expanded position of the gripper jaws.

One feature or aspect of an embodiment is believed at the time of the filing of this patent application to possibly reside broadly in a gripper device for handling tube sleeves that are used in shrink-sleeve labeling stations or stretch-sleeve labeling stations, characterized in that means are present that can adjust the position of the gripper jaw 2 expansion.

Another feature or aspect of an embodiment is believed at the time of the filing of this patent application to possibly reside broadly in a gripper characterized in that the adjustment of the position of the gripper jaw 2 expansion can be carried out without change of the magnitude of the gripper jaw expansion.

Yet another feature or aspect of an embodiment is believed at the time of the filing of this patent application to possibly reside broadly in a gripper characterized in that the means comprise a combination comprising a screw, for example, a stud screw 6 and an abutment element, for example, a stud 7.

Still another feature or aspect of an embodiment is believed at the time of the filing of this patent application to possibly reside broadly in a gripper characterized in that the means comprise a combination comprising a pinion gear and a pinion rod.

A further feature or aspect of an embodiment is believed at the time of the filing of this patent application to possibly reside broadly in a gripper characterized in that the means comprise a combination comprising planar spacer elements, such as, for example, sheet metal and an abutment.

Another feature or aspect of an embodiment is believed at the time of the filing of this patent application to possibly reside broadly in a gripper characterized in that the means comprise a combination comprising spacer rings, a receiver structure for such spacer rings, and an abutment.

The components disclosed in the various publications, disclosed or incorporated by reference herein, may possibly be used in possible embodiments of the present invention, as well as equivalents thereof.

Some examples of bottling systems that may possibly be utilized or possibly adapted for use in at least one possible embodiment of the present application may possibly be found in the following U.S. patents, all assigned to the Assignee herein, namely: U.S. Pat. Nos. 4,911,285; 4,944,830; 4,950,350; 4,976,803; 4,981,547; 5,004,518; 5,017,261; 5,062,917; 5,062,918; 5,075,123; 5,078,826; 5,087,317; 5,110,402; 5,129,984; 5,167,755; 5,174,851; 5,185,053; 5,217,538; 5,227,005; 5,413,153; 5,558,138; 5,634,500; 5,713,403; 6,276,113; 6,213,169; 6,189,578; 6,192,946; 6,374,575; 6,365,054; 6,619,016; 6,474,368; 6,494,238; 6,470,922; and U.S. Pat. No. 6,463,964.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of methods and apparatuses for closing bottles and containers and their components that may possibly be utilized or possibly adapted for use in at least one possible embodiment of the present may possibly be found in the following U.S. Pat. No. 5,398,485 issued to Osifchin on Mar. 21, 1995; U.S. Pat. No. 5,402,623 issued to Ahlers on Apr. 4, 1995; U.S. Pat. No. 5,419,094 issued to Vander Bush, Jr. et al. on May 30, 1995; U.S. Pat. No. 5,425,402 issued to Pringle on Jun. 20, 1995; U.S. Pat. No. 5,447,246 issued to Finke on Sep. 5, 1995; and U.S. Pat. No. 5,449,080 issued to Finke on Sep. 12, 1995.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of apparatus and methods of attaching sleeve labels that may possibly be utilized or possibly adapted for use in at least one possible embodiment of the present application may possibly be found in the following U.S. Pat. No. 4,108,705 issued to Hadl et al. on Aug. 22, 1978; U.S. Pat. No. 4,357,788 issued to Amberg on Nov. 9, 1982; U.S. Pat. No. 5,415,721 issued to Nickey et al. on May 16, 1995; U.S. Pat. No. 5,422,152 issued to Langeland et al. on Jun. 6, 1995; U.S. Pat. No. 5,433,057 issued to Lerner et al. on Jul. 18, 1995; U.S. Pat. No. 5,775,019 issued to Johnson on Jul. 7, 1998; U.S. Pat. No. 6,543,514 issued to Menayan on Apr. 8, 2003; and U.S. Pat. No. 6,523,328 issued to De Cardenas et al. on Feb. 25, 2003.

All, or substantially all, of the components and methods of the various embodiments may be used with at least one embodiment or all of the embodiments, if more than one embodiment is described herein.

The corresponding foreign and international patent publication applications, namely, Federal Republic of Germany Patent Application No. DE P 103 14 635.0, filed on Apr. 1, 2003, having inventor Lutz DECKERT, and DE-OS 103 14 635, and DE-PS 103 14 635 as well as their published equivalents, and other equivalents or corresponding applications, if any, in corresponding cases in Germany and elsewhere, and the references and documents cited in any of the documents cited herein, such as the patents, patent applications and publications, are hereby incorporated by reference as if set forth in their entirety herein.

Some examples of apparatus and methods of gripping or handling of sleeve labels form that may possibly be utilized or possibly adapted for use in at least one possible embodiment of the present application may possibly be found in the following U.S. Pat. No. 3,852,940 issued to Kinoshita on Dec. 10, 1974; U.S. Pat. No. 4,102,728 issued to Smith on Jul. 25, 1978; U.S. Pat. No. 4,184,309 issued to Amberg on Jan. 22, 1980; U.S. Pat. No. 4,412,876 issued to Lerner et al. on Nov. 1, 1983; U.S. Pat. No. 4,446,616 issued to Waterman on May 8, 1984; U.S. Pat. No. 4,519,186 issued to Winter et al. on May 28, 1985; U.S. Pat. No. 4,620,888 issued to Easter et al. on Nov. 4, 1986; U.S. Pat. No. 4,914,893 issued to Strub et al. on Apr. 10, 1990; U.S. Pat. No. 4,944,825 issued to Gifford et al. on Jul. 31, 1990; U.S. Pat. No. 5,483,783 issued to Lerner et al. on Jan. 16, 1996; and U.S. Pat. No. 5,759,337 issued to Fujio et al. on Jun. 2, 1998;

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

The co-pending U.S. patent application Ser. No. 10/653,617 filed on Sep. 2, 2003 having inventors Klaus KRÄMER and Lutz DECKERT, having the title "Labeling machine with a sleeve mechanism for preparing and applying cylindrical labels onto beverage bottles and other beverage containers in a beverage container filling plant," and having attorney docket No. NHL-HOL-60 and its German priority patent application No. DE P 102 40 520.3, filed on Sep. 3, 2002, having inventors Klaus KRÄMER and Lutz DECKERT and other equivalents or corresponding applications, if any, in corresponding cases in Germany and elsewhere, and the references and documents cited in any of the documents cited therein, such as the patents, patent applications and publications, are hereby incorporated by reference as if set forth in their entirety herein.

Some examples of control or pinch rollers that may possibly be utilized or possibly adapted for use in at least one possible embodiment of the present application may possibly be found in the following U.S. Pat. No. 4,081,149 issued to Miller on Mar. 28, 1978; U.S. Pat. No. 4,732,374 issued to Honegger on Mar. 22, 1988; U.S. Pat. No. 4,756,520 issued to Clark, Jr. et al. on Jul. 12, 1988; U.S. Pat. No. 5,265,313 issued to Rutz on Nov. 30, 1993; U.S. Pat. No. 5,402,556 issued to Rutz on Apr. 4, 1995; U.S. Pat. No. 6,037,739 issued to Hartramph et al. on Mar. 14, 2000.

The co-pending U.S. patent application Ser. No. 10/780,280, filed on Feb. 17, 2004 having inventor Heinz-Michael ZWILLING, having the title "A beverage bottling plant for filling bottles with a liquid beverage filling material, a container filling plant container information adding station, such as, a labeling station, configured to add information to containers, such as, bottles and cans, and modules for labeling stations", and having attorney docket No. NHL-HOL-65 and its German priority patent application No. DE P 103 06 671, filed on Feb. 18, 2003, having inventor Heinz-Michael ZWILLING and other equivalents or corresponding applications, if any, in corresponding cases in Germany and elsewhere, and the references and documents cited in any of the documents cited therein, such as the patents, patent applications and publications, are hereby incorporated by reference as if set forth in their entirety herein.

All of the patents, patent applications and publications recited herein, and in the Declaration attached hereto, are hereby incorporated by reference as if set forth in their entirety herein.

The co-pending U.S. patent application Ser. No. 10/793,659, filed on Mar. 4, 2004 having inventor Horst LÖFFLER, having the title "A beverage bottling plant for filling bottles with a liquid beverage filling material, and a container filling plant container information adding station, such as, a labeling station having a sleeve label cutting arrangement, configured to add information to containers, such as, bottles and cans,", and having attorney docket No. NHL-HOL-69 and its German priority patent application No. DE P 103 09 459.835, filed on Mar. 5, 2003, having inventor Horst LÖFFLER and other equivalents or corresponding applications, if any, in corresponding cases in Germany and elsewhere, and the references and documents cited in any of the documents cited therein, such as the patents, patent applications and publications, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of expanding mandrel structures that my possibly be utilized or possibly adapted for use in at least one possible embodiment of the present application may possibly be found in the following U.S. Pat. No. 4,936,130 issued to Kramer on Jun. 26, 1990; U.S. Pat. No. 4,840,360 issued to Bartley on Jun. 20, 1989; U.S. Pat. No. 4,229,014 issued to Crowe on Oct. 21, 1980; U.S. Pat. No. 5,009,002 issued to Kelly on Apr. 23, 1991; U.S. Pat. No. 5,685,190 issued to Yamamoto et al. on Nov. 11, 1997; and U.S. Pat. No. 6,435,520 issued to Barbieux on Aug. 20, 2002.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

Some examples of expanding mandrel structures using lever action that may possibly be utilized or possibly adapted for use in at least one possible embodiment of the present application may possibly be found in the following U.S. Pat. No. 4,144,735 issued to Rothenberger on Mar. 20, 1979; U.S. Pat. No. 4,214,860 issued to Kleimenhagen et al. on Jul. 29, 1980; U.S. Pat. No. 4,936,130 issued to Kramer on Jun. 26, 1990; U.S. Pat. No. 5,046,349 issued to Velte on Sep. 10, 1991 and U.S. Pat. No. 5,243,845 issued to Velte on Sep. 14, 1993.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

Some examples of expanding mandrel structures using pneumatic action that may possibly be utilized or possibly adapted for use in at least one possible embodiment of the present application may possibly be found in the following U.S. Pat. No. 4,144,735 issued to Rothenberger on Mar. 20, 1979, U.S. Pat. No. 5,009,002 issued to Kelly on Apr. 23, 1991; and U.S. Pat. No. 5,062,199 issued to Kelly on Nov. 5, 1991.

The details in the patents, patent applications and publications may be considered to be incorporable, at applicant's option, into the claims during prosecution as further limitations in the claims to patentably distinguish any amended claims from any applied prior art.

Some examples of expanding mandrel structures using hydraulic action that may possibly be utilized or possibly adapted for use in at least one possible embodiment of the present application may possibly be found in the following U.S. Pat. No. 3,938,235 issued to Wendt, III et al. on Feb. 17, 1976; U.S. Pat. No. 4,124,173 issued to Damour on Nov. 7, 1978; U.S. Pat. No. 4,387,845 issued to Mefferd on Jun. 14, 1983; U.S. Pat. No. 4,665,732 issued to Hogenhout on May 19, 1987; U.S. Pat. No. 5,243,845 issued to Velte on Sep. 14, 1993; and U.S. Pat. No. 5,685,190 issued to Yamamoto et al. an Nov. 11, 1997.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

Some examples of expanding mandrel structures using electromagnetic force that may possibly be utilized or possibly adapted for use in at least one possible embodiment of the present application may possibly be found in the following U.S. Pat. No. 4,688,139 issued to Nagata et al. on Aug. 18, 1987; U.S. Pat. No. 5,259,672 issued to Rowe on Nov. 9, 1993; U.S. Pat. No. 6,044,705 issued to Neukermans et al. on Apr. 4, 2000; U.S. Pat. No. 6,516,758 issued to Leiber on Feb. 11, 2003; and U.S. Pat. No. 6,556,737 issued to Miu et al. on Apr. 29, 2003.

The abstract of the disclosure is submitted herewith as required by 37 C.F.R. §1.72(b). As stated in 37 C.F.R. §1.72(b):

A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

Some examples of microprocessors that may possibly be utilized or possibly adapted for use in at least one possible embodiment of the present application may possibly be found in the following U.S. Pat. No. 6,095,987 issued to Shmulewitz et al. on Aug. 1, 2000; U.S. Pat. No. 6,516,331 issued to Beiu on Feb. 4, 2003; U.S. Pat. No. 6,522,981 issued to Smit et al. on Feb. 18, 2003; U.S. Pat. No. 6,539,502 issued to Davidson et al. on Mar. 25, 2003; U.S. Pat. No. 6,553,460 issued to Chopra et al. on Apr. 22, 2003; U.S. Pat. No. 6,557,098 issued to Oberman et al. on Apr. 29, 2003; U.S. Pat. No. 6,571,363 issued to Steiss on May 27, 2003; and U.S. Pat. No. 6,574,724 issued to Hoyle et al. on Jun. 3, 2003.

Some examples of cutting apparatus that may possibly be utilized or possibly adapted for use in at least one possible embodiment of the present may possibly be found in the following U.S. Pat. No. 5,060,367 issued to Vandevoorde on Oct. 29, 1991; U.S. Pat. No. 5,091,237 issued to Scloegl et al. on Feb. 25, 1992; U.S. Pat. No. 5,715,651 issued to Thebault on Feb. 10, 1998; U.S. Pat. No. 5,916,343 issued to Huang et al. on Jun. 29, 1999; U.S. Pat. No. 6,502,488 issued to Taylor on Jan. 7, 2003; and U.S. Pat. No. 6,684,599 issued to Fresnel on Feb. 3, 2004.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A method of operating a container filling plant container labeling station having a sleeve label adding arrangement, configured to add a label to a container, said container labeling station comprising:

an arrangement being configured and disposed to open a continuous tube of uncut sleeve labels;

apparatus being configured and disposed to advance a tube of sleeve labels;

apparatus being configured and disposed to cut a sleeve label from a tube of uncut sleeve labels; and a sleeve label adding arrangement being configured and disposed to add an open sleeve label about a container to be labeled;

said sleeve label adding arrangement comprising:

a sleeve label holding and releasing structure comprising a first portion and a second portion together being configured and disposed to permit holding open of an open sleeve label and to permit releasing of an open sleeve label about a container to be labeled;

said first portion being configured and disposed to hold and to release a first portion of an open sleeve label;

said second portion being configured and disposed to hold and to release a second, different, portion of an open sleeve label; and an adjustment and securing arrangement being configured and disposed to adjust and then to secure said sleeve label holding and releasing structure in a first position which corresponds to a diameter of a first type of sleeve label for a first type of container, and being configured and disposed to adjust and then to secure said sleeve label holding and releasing structure in a second position which corresponds to a diameter of a second type of sleeve label for a second type of container, which diameter of said second type of sleeve label is different than the diameter of said first type of sleeve label; said method comprising the steps of:

labeling a plurality of a first type of container, wherein said step of labeling said plurality of a first type of container comprises the steps of:

adjusting and then securing said first and second holding and releasing portions with said adjustment arrangement in a first position which corresponds to a diameter of a first type of sleeve label for the first type of container;

opening a continuous, collapsed, uncut tube of the first type of sleeve labels;

advancing the continuous tube of the first type of sleeve labels;

cutting a sleeve label from the continuous tube of the first type of sleeve labels;

holding the open sleeve label with said first and second holding and releasing portions;

positioning the open sleeve label about one of the first type of containers with said first and second holding and releasing portions;

releasing the open sleeve label from said first and second holding and releasing portions; and repeating the above steps for subsequent containers of said plurality of the first type of container;

stopping labeling upon labeling a desired number of said plurality of the first type of container;

selecting a second type of container to be labeled;

labeling a plurality of the second type of container, wherein said step of labeling said plurality of the second type of container comprises the steps of:

adjusting and then securing said first and second holding and releasing portions with said adjustment arrangement in a second position which corresponds to a diameter of a second type of sleeve label for the second type of container, which diameter of the second type of sleeve label is different than the diameter of the first type of sleeve label; and repeating the steps for placing the first type of sleeve label on said plurality of the first type of container to place the second type of sleeve label on said plurality of the second type of container.

2. The method of operating a container filling plant container labeling station having a sleeve label adding arrangement, according to claim 1, wherein said method further comprises the steps of:

stopping labeling said plurality of the second type of container;

selecting one of: the first type of container or another type of container different from the first and second types of container to be labeled;

adjusting and then securing said first and second holding and releasing portions with said adjustment arrangement in a position which corresponds to the diameter of the selected type of sleeve label for the selected type of container; and repeating the steps for placing the first type of sleeve label on said plurality of the first type of container to place the selected type of sleeve label on a plurality of the selected type of container.

3. The method of operating a container filling plant container labeling station having a sleeve label adding arrangement, according to claim 2, wherein said sleeve label adding arrangement comprises an arrangement being configured and disposed to move said sleeve label holding and releasing structure to permit positioning of an open sleeve label about a container to be labeled; wherein said method comprises the step of moving said sleeve label holding and releasing structure.

4. The method of operating a container filling plant container labeling station having a sleeve label adding arrangement, according to claim 3, comprising at least one of: (a), (b), (c), and (d), wherein (a), (b), (c), and (d) comprise:

(a) said adjustment arrangement is configured and disposed to position and then to secure at least one of: (i) said first sleeve label holding and releasing portion, and (ii) said second sleeve label holding and releasing portion, to minimize misalignment of a sleeve label about a container; and said method comprises the steps of:

positioning and then securing at least one of (i) and (ii) to minimize misalignment of a sleeve label about a container to be labeled;

(b) said first sleeve label holding and releasing portion and said second sleeve label holding and releasing portion are configured and disposed to hold a sleeve label at the inside of a sleeve label and to release a sleeve label; and said method comprises the steps of:

holding a sleeve label at the inside of a sleeve with said first sleeve label holding and releasing portion and said second sleeve label holding and releasing portion; and releasing a sleeve label at the inside from said first sleeve label holding and releasing portion and said second sleeve label holding and releasing portion;

(c) said adjustment arrangement is configured and disposed to position and to retain said first holding and releasing portion and said second holding and releasing portion at a distance from one another to minimize misalignment of a sleeve label about a container; and said method comprises the steps of:

positioning said first holding and releasing portion and said second holding and releasing portion at a distance from one another; and retaining said first holding and releasing portion and said second holding and releasing portion at a distance from one another to minimize misalignment of a sleeve label about a container to be labeled; and (d) said first and second holding and releasing portions are configured to be independently adjustable by said adjustment arrangement to permit gripping of one of: a shrink-sleeve label and a stretch-sleeve label;

said adjustment arrangement comprises an arrangement being configured and disposed to secure each holding and releasing portion independently of one another; and said method comprises the steps of:

adjusting said first holding and releasing portion with said adjustment arrangement to permit gripping of one of: said shrink-sleeve label and said stretch-sleeve label;

adjusting said second holding and releasing portion with said adjustment arrangement to permit gripping of one of: said shrink-sleeve label and said stretch-sleeve label; and securing said first holding and releasing portion and said second holding and releasing portion with said arrangement being configured and disposed to secure each holding and releasing portion independently of one another.

5. The method of operating a container filling plant container labeling station having a sleeve label adding, according to claim 4, comprising at least one of (a), (b), (c), and (d) wherein (a), (b), (c), and (d) comprise:

(a) said adjustment arrangement comprises a screw and a stop structure for each holding and releasing portion;

each said screw with its corresponding stop structure is configured and disposed to adjust its corresponding holding and releasing portion to minimize misalignment of a sleeve label about a container;

said method comprises the step of:

rotating a screw against its corresponding stop structure to adjust its corresponding holding and releasing portion to minimize misalignment of a sleeve label about a container to be labeled;

(b) said adjustment arrangement comprises a pinion gear and a pinion rack for each holding and releasing portion;

each said pinion gear with its corresponding pinion rack is configured and disposed to adjust its corresponding holding and releasing portion to minimize misalignment of a sleeve label about a container;

said method comprises the step of:

rotating a pinion gear to adjust its corresponding holding and releasing portion;

(c) said adjustment arrangement comprises a planar spacer element and an abutment structure for each holding and releasing portion;

each said planar spacer element with its corresponding abutment structure is configured and disposed to adjust its corresponding holding and releasing portion to minimize misalignment of a sleeve label about a container; and said planar spacer element comprises sheet metal;

said method comprises the step of:

positioning a planar spacer element against its corresponding abutment structure to minimize misalignment of a sleeve label about a container; and (d) said adjustment arrangement comprises a check structure, a plurality of spacer rings, and a receiver structure configured to receive said spacer rings;

each said check structure with its corresponding plurality of spacer rings, and with its corresponding receiver structure is configured to adjust its corresponding holding and releasing portion to minimize misalignment of a sleeve label about a container;

said method comprises the steps of:

selecting a plurality of spacer rings; and positioning a plurality of spacer rings on its corresponding receiver structure and against its corresponding check structure.

6. A beverage bottling plant for filling bottles with a liquid beverage filling material, said beverage bottling plant comprising:

a filling machine being configured to fill empty bottles with liquid beverage filling material;

a conveyer arrangement being configured and disposed to move empty bottles to said filling machine;

said beverage filling machine comprising a plurality of beverage filling positions, each beverage filling position comprising a beverage filling device for filling bottles with liquid beverage filling material;

said filling devices comprising apparatus being configured to introduce a predetermined volume of liquid beverage filling material into the interior of bottles to a substantially predetermined level of liquid beverage filling material;

said apparatus being configured to introduce a predetermined volume of liquid beverage filling material comprising apparatus being configured to terminate the filling of beverage bottles upon liquid beverage filling material reaching said substantially predetermined level in bottles;

a closing station being configured and disposed to close filled bottles;

a conveyer arrangement being configured and disposed to transfer filled bottles from said filling machine to said closing station;

a labeling station being configured and disposed to receive bottles to be labeled;

a conveyer arrangement being configured and disposed to convey bottles to said labeling station;

said labeling station comprising:

a storage being configured and disposed to store a continuous collapsed tube of flat uncut sleeve labels disposed sequentially one after the other;

a mandrel structure;

said mandrel structure being configured to open a continuous collapsed tube of uncut sleeve labels;

said mandrel structure having a receiving end and a discharge end remote from said receiving end;

a first set of roller apparatus being configured and disposed to advance an opened continuous tube of uncut sleeve labels along said mandrel structure from said receiving end towards said discharge end;

said first set of roller apparatus being disposed adjacent said receiving end of said mandrel structure;

a second set of roller apparatus being configured and disposed to advance an opened continuous tube of uncut sleeve labels along said mandrel structure to said discharge end;

said second set of roller apparatus being disposed between said first set of roller apparatus and said discharge end of said mandrel structure;

apparatus being configured and disposed to cut an opened sleeve label from an opened continuous tube of uncut opened sleeve labels to thus produce a cut opened sleeve label for a bottle disposed at said discharge end of said mandrel structure;

said cutting apparatus comprising a rotating disc having at least one sleeve cutting knife operatively connected thereto;

each said at least one sleeve cutting knife being configured and disposed to be moved between a position of rest and a position of cutting;

each said at least one sleeve cutting knife comprises a portion configured to move said at least one sleeve cutting knife into the cutting position, and also comprises a structure to move said at least one sleeve cutting knife into the rest position;

said cutting apparatus also comprising at least one electromagnet configured and disposed to move said at least one sleeve cutting knife into the cutting position;

said cutting apparatus being disposed between said first set of roller apparatus and said second set of roller apparatus;

said mandrel structure comprising an expander apparatus being configured and disposed to sufficiently expand a portion of an uncut opened sleeve label, immediately adjacent said cutting apparatus, between said first set of roller apparatus and said second set of roller apparatus, to make taut a portion of an opened tube of uncut opened sleeve labels adjacent said cutting apparatus and thus to minimize bunching of an opened continuous tube of uncut opened sleeve labels on said mandrel structure, and also to maximize precision of the cut being effectuated by said cutting apparatus; and said second set of roller apparatus also being configured and disposed to remove a cut opened sleeve label from said mandrel structure with sufficient velocity and to position a cut opened sleeve label about a bottle disposed at said discharge end of said mandrel structure, and thus to permit a constant cut of a sleeve label being cut and elevated cutting speeds to afford shorter cycle times;

a gripper arrangement being configured and disposed to grip an opened sleeve label cut by said cutting apparatus and to dispose a cut opened sleeve label about a bottle to be labeled;

said gripper arrangement comprising:

a base structure;

a first gripper jaw and a second gripper jaw;

each gripper jaw being configured to grip a cut opened sleeve in its opened condition;

each gripper jaw being configured to be connected to said base structure;

a first support structure being configured and disposed to connect said first gripper jaw to said base structure;

a second support structure being configured and disposed to connect said second gripper jaw to said base structure;

each support structure comprising a locating bolt being configured and disposed to connect its corresponding support structure for rotation at said base structure and to permit movement of said gripper jaws into a position wherein a cut opened sleeve label is gripped by said gripper jaws and also into a position wherein a cut opened sleeve label is released from said gripper jaws;

each support structure comprising a guide pin being configured and disposed to connect its corresponding gripper jaw portion to its corresponding support structure;

an actuator arrangement being configured and disposed to actuate said guide pins to move said gripper jaws into a position wherein a cut opened sleeve label is gripped by said gripper jaws and also into a position wherein a cut opened sleeve label is released from said gripper jaws;

each gripper jaw having a slot-type passage being configured and disposed to permit adjusting of its corresponding gripper jaw;

each support structure comprising a passage having a diameter;

each gripper jaw slot-type passage being configured to be aligned with its corresponding support structure passage to permit adjustment of its corresponding gripper jaw;

each support structure comprising a stud being configured to be fixedly disposed in said support structure passage and to extend through said gripper jaw slot-type passage of its corresponding gripper jaw to secure its corresponding gripper jaw to its corresponding support structure subsequent to adjustment of a corresponding gripper jaw;

each gripper jaw comprising:

an adjustment structure being configured and disposed to adjust its corresponding gripper jaw between an initial position and a final position, which final position being a position configured to minimize misalignment of a cut opened sleeve about a bottle to be labeled; and each support structure further comprising:

a securing structure being configured and disposed to secure its corresponding gripper jaw to its corresponding support structure subsequent to movement of each gripper jaw into said final gripper jaw position by its corresponding adjustment structure; and said labeling station further comprising: apparatus being configured and disposed to secure a cut opened sleeve label, positioned by said gripper arrangement about a bottle, to the surface of a bottle to be labeled.

7. The beverage bottling plant for filling bottles, according to claim 6, wherein:

said gripper arrangement comprises an arrangement being configured and disposed to move said gripper arrangement to permit positioning of an open sleeve label about a bottle to be labeled.

8. The beverage bottling plant for filling bottles, according to claim 7, wherein:

said first gripper jaw and said second gripper jaw are configured and disposed to hold and to release a sleeve label at the inside of a sleeve label.

9. The beverage bottling plant for filling bottles according to claim 8, comprising at least one of (a) and (b), wherein (a) and (b), comprise:

(a) said first gripper jaw and said second gripper jaw are configured to grip one of (i) and (ii), wherein (i) and (ii) comprise:

(i) a shrink-sleeve label; and (ii) a stretch-sleeve label; and (b) said adjustment structure comprises at least one of (iii), (iv), (v), and (vi), wherein (iii), (iv), (v), and (vi) comprise:

(iii) a screw being configured and disposed to be in contact with said fixed stud and to move its corresponding gripper jaw between a first position and a second position, which second gripper jaw position being a position configured to minimize misalignment of a cut opened sleeve gripped by said gripper jaws; and a spring being configured and disposed to exert a bias on said screw and its corresponding gripper jaw;

(iv) a pinion gear and a pinion rack for each gripper jaw;

each said pinion gear with its corresponding pinion rack is configured and disposed to adjust its corresponding gripper jaw to minimize misalignment of a sleeve label about a bottle to be labeled;

(v) a planar spacer element and an abutment structure for each gripper jaw;

each said planar spacer element with its corresponding abutment structure is configured and disposed to adjust its corresponding gripper jaw to minimize misalignment of a sleeve label about a bottle to be labeled; and said planar spacer element comprises sheet metal; and (vi) a check structure, a plurality of spacer rings, and a receiver structure configured to receive said spacer rings; and each said check structure with its corresponding plurality of spacer rings, and with its corresponding receiver structure is configured to adjust its corresponding gripper jaw to minimize misalignment of a sleeve label about a bottle to be labeled.

10. A container filling plant container labeling station having a sleeve label adding arrangement, configured to add a label to a container, said container labeling station comprising:

an arrangement being configured and disposed to open a continuous tube of uncut sleeve labels;

apparatus being configured and disposed to advance a tube of sleeve labels;

apparatus being configured and disposed to cut a sleeve label from a tube of uncut sleeve labels;

a sleeve label adding arrangement being configured and disposed to add an open sleeve label about a container to be labeled: and said sleeve label adding arrangement comprising:

a sleeve label holding and releasing structure comprising a first portion and a second portion together being configured and disposed to permit holding open of an open sleeve label and to permit releasing of an open sleeve label about a container to be labeled;

said first portion being configured and disposed to hold and to release a first portion of an open sleeve label;

said second portion being configured and disposed to hold and to release a second, different, portion of an open sleeve label;

an adjustment and securing arrangement being configured and disposed to adjust and then to secure said sleeve label holding and releasing structure in a first position which corresponds to a diameter of a first type of sleeve label for a first type of container in a first labeling process, and being configured and disposed to re-adjust and then re-secure said sleeve label holding and releasing structure in at least a second position which corresponds to a diameter of at least a second type of sleeve label for at least a second type of container in at least a second labeling process, which diameter of the at least second type of sleeve label is different than the diameter of the first type of sleeve label; and an arrangement being configured and disposed to move said sleeve label holding and releasing structure to permit positioning of an open sleeve label about a container to be labeled;

said adjustment arrangement is configured and disposed to position and then to secure at least one of: (i) said first sleeve label holding and releasing portion, and (ii) said second sleeve label holding and releasing portion, to minimize misalignment of a sleeve label about a container;

said first sleeve label holding and releasing portion and said second sleeve label holding and releasing portion are configured and disposed to hold a sleeve label at the inside of a sleeve label and to release a sleeve label;

said adjustment arrangement is configured and disposed to position and to retain said first holding and releasing portion and said second holding and releasing portion at a distance from one another to minimize misalignment of a sleeve label about a container;

said first and second holding and releasing portions are configured to be independently adjustable by said adjustment arrangement to permit griping of one of: a shrink-sleeve label and a stretch-sleeve label;

said adjustment arrangement comprises an arrangement being configured and disposed to secure each holding and releasing portion independently of one another;

said adjustment arrangement comprises a screw and a stop structure for each holding and releasing portion;

each said screw with its corresponding stop structure is configured and disposed to adjust its corresponding holding and releasing portion to minimize misalignment of a sleeve label about a container; and said screw comprises a stud screw and said stop structure comprises a stud.

11. A container filling plant container labeling station having a sleeve label adding arrangement, configured to add a label to a container, said container labeling station comprising:

an arrangement being configured and disposed to open a continuous tube of uncut sleeve labels;

apparatus being configured and disposed to advance a tube of sleeve labels;

apparatus being configured and disposed to cut a sleeve label from a tube of uncut sleeve labels;

a sleeve label adding arrangement being configured and disposed to add an open sleeve label about a container to be labeled; and said sleeve label adding arrangement comprising:

a sleeve label holding and releasing structure comprising a first portion and a second portion together being configured and disposed to permit holding open of an open sleeve label and to permit releasing of an open sleeve label about a container to be labeled;

said first portion being configured and disposed to hold and to release a first portion of an open sleeve label;

said second portion being configured and disposed to hold and to release a second, different, portion of an open sleeve label;

an adjustment and securing arrangement being configured and disposed to adjust and then to secure said sleeve label holding and releasing structure in a first position which corresponds to a diameter of a first type of sleeve label for a first type of container in a first labeling process, and being configured and disposed to re-adjust and then re-secure said sleeve label holding and releasing structure in at least a second position which corresponds to a diameter of at least a second type of sleeve label for at least a second type of container in at least a second labeling process, which diameter of the at least second type of sleeve label is different than the diameter of the first type of sleeve label; and an arrangement being configured and disposed to move said sleeve label holding and releasing structure to permit positioning of an open sleeve label about a container to be labeled;

said adjustment arrangement is configured and disposed to position and then to secure at least one of: (i) said first sleeve label holding and releasing portion, and (ii) said second sleeve label holding and releasing portion, to minimize misalignment of a sleeve label about a container;

said first sleeve label holding and releasing portion and said second sleeve label holding and releasing portion are configured and disposed to hold a sleeve label at the inside of a sleeve label and to release a sleeve label;

said adjustment arrangement is configured and disposed to position and to retain said first holding and releasing portion and said second holding and releasing portion at a distance from one another to minimize misalignment of a sleeve label about a container;

said first and second holding and releasing portions are configured to be independently adjustable by said adjustment arrangement to permit gripping of one of: a shrink-sleeve label and a stretch-sleeve label;

said adjustment arrangement comprises an arrangement being configured and disposed to secure each holding and releasing portion independently of one another;

said adjustment arrangement comprises a pinion gear and a pinion rack for each holding and releasing portion; and each said pinion gear with its corresponding pinion rack is configured and disposed to adjust its corresponding holding and releasing portion to minimize misalignment of a sleeve label about a container.

12. A container filling plant container labeling station having a sleeve label adding arrangement, configured to add a label to a container, said container labeling station comprising:

an arrangement being configured and disposed to open a continuous tube of uncut sleeve labels;

apparatus being configured and disposed to advance a tube of sleeve labels;

apparatus being configured and disposed to cut a sleeve label from a tube of uncut sleeve labels;

a sleeve label adding arrangement being configured and disposed to add an open sleeve label about a container to be labeled; and said sleeve label adding arrangement comprising:

a sleeve label holding and releasing structure comprising a first portion and a second portion together being configured and disposed to permit holding open of an open sleeve label and to permit releasing of an open sleeve label about a container to be labeled;

said first portion being configured and disposed to hold and to release a first portion of an open sleeve label;

said second portion being configured and disposed to hold and to release a second, different, portion of an open sleeve label;

an adjustment and securing arrangement being configured and disposed to adjust and then to secure said sleeve label holding and releasing structure in a first position which corresponds to a diameter of a first type of sleeve label for a first type of container in a first labeling process, and being configured and disposed to re-adjust and then re-secure said sleeve label holding and releasing structure in at least a second position which corresponds to a diameter of at least a second type of sleeve label for at least a second type of container in at least a second labeling process, which diameter of the at least second type of sleeve label is different than the diameter of the first type of sleeve label; and an arrangement being configured and disposed to move said sleeve label holding and releasing structure to permit positioning of an open sleeve label about a container to be labeled;

said adjustment arrangement is configured and disposed to position and then to secure at least one of: (i) said first sleeve label holding and releasing portion, and (ii) said second sleeve label holding and releasing portion, to minimize misalignment of a sleeve label about a container;

said first sleeve label holding and releasing portion and said second sleeve label holding and releasing portion are configured and disposed to hold a sleeve label at the inside of a sleeve label and to release a sleeve label;

said adjustment arrangement is configured and disposed to position and to retain said first holding and releasing portion and said second holding and releasing portion at a distance from one another to minimize misalignment of a sleeve label about a container;

said first and second holding and releasing portions are configured to be independently adjustable by said adjustment arrangement to permit gripping of one of: a shrink-sleeve label and a stretch-sleeve label;

said adjustment arrangement comprises an arrangement being configured and disposed to secure each holding and releasing portion independently of one another;

said adjustment arrangement comprises a planar spacer element and an abutment structure for each holding and releasing portion;

each said planar spacer element with its corresponding abutment structure is configured and disposed to adjust its corresponding holding and releasing portion to minimize misalignment of a sleeve label about a container; and said planar spacer element comprises sheet metal.

13. A container filling plant container labeling station having a sleeve label adding arrangement, configured to add a label to a container, said container labeling station comprising:

an arrangement being configured and disposed to open a continuous tube of uncut sleeve labels;

apparatus being configured and disposed to advance a tube of sleeve labels;

apparatus being configured and disposed to cut a sleeve label from a tube of uncut sleeve labels;

a sleeve label adding arrangement being configured and disposed to add an open sleeve label about a container to be labeled; and said sleeve label adding arrangement comprising:

a sleeve label holding and releasing structure comprising a first portion and a second portion together being configured and disposed to permit holding open of an open sleeve label and to permit releasing of an open sleeve label about a container to be labeled;

said first portion being configured and disposed to hold and to release a first portion of an open sleeve label;

said second portion being configured and disposed to hold and to release a second, different, portion of an open sleeve label;

an adjustment and securing arrangement being configured and disposed to adjust and then to secure said sleeve label holding and releasing structure in a first position which corresponds to a diameter of a first type of sleeve label for a first type of container in a first labeling process, and being configured and disposed to re-adjust and then re-secure said sleeve label holding and releasing structure in at least a second position which corresponds to a diameter of at least a second type of sleeve label for at least a second type of container in at least a second labeling process, which diameter of the at least second type of sleeve label is different than the diameter of the first type of sleeve label; and an arrangement being configured and disposed to move said sleeve label holding and releasing structure to permit positioning of an open sleeve label about a container to be labeled;

said adjustment arrangement is configured and disposed to position and then to secure at least one of: (i) said first sleeve label holding and releasing portion, and (ii) said second sleeve label holding and releasing portion, to minimize misalignment of a sleeve label about a container;

said first sleeve label holding and releasing portion and said second sleeve label holding and releasing portion are configured and disposed to hold a sleeve label at the inside of a sleeve label and to release a sleeve label;

said adjustment arrangement is configured and disposed to position and to retain said first holding and releasing portion and said second holding and releasing portion at a distance from one another to minimize misalignment of a sleeve label about a container;

said first and second holding and releasing portions are configured to be independently adjustable by said adjustment arrangement to permit gripping of one of: a shrink-sleeve label and a stretch-sleeve label;

said adjustment arrangement comprises an arrangement being configured and disposed to secure each holding and releasing portion independently of one another;

said adjustment arrangement comprises for each holding and releasing portion: a check structure, a plurality of spacer rings, and a receiver structure configured to receive said spacer rings; and each said check structure with its corresponding plurality of spacer rings, and with its corresponding receiver structure is configured to adjust its corresponding holding and releasing portion to minimize misalignment of a sleeve label about a container.

* * * * *